US005746321A

United States Patent [19]

Hettinger, Jr. et al.

[11] Patent Number: 5,746,321

[45] Date of Patent: May 5, 1998

[54] COMBINATION MAGNETIC SEPARATION, CLASSIFICATION AND ATTRITION PROCESS FOR RENEWING AND RECOVERING PARTICULATES

[75] Inventors: William P. Hettinger, Jr., Deerfield Beach, Fla.; Howard F. Moore, Catlettsburg, Ky.; Terry L. Goolsby, Ashland, Ky.; A. V. Peppard, Catlettsburg, Ky.

[73] Assignee: Ashland Inc., Ashland, Ky.

[21] Appl. No.: 459,012

[22] Filed: Jul. 27, 1995

Related U.S. Application Data

[60] Division of Ser. No. 305,525, Sep. 13, 1994, Pat. No. 5,636,747, which is a continuation-in-part of Ser. No. 695,188, May 3, 1991, Pat. No. 5,393,412.

[51] Int. Cl.[6] ..... B07B 1/00; C10G 11/00

[52] U.S. Cl. ..... 209/233; 209/715; 208/113

[58] Field of Search ..... 209/38, 212, 213, 209/214, 219, 222, 636, 638, 642, 39, 233, 715; 208/113, 120, 251 R; 502/5, 21

[56] References Cited

U.S. PATENT DOCUMENTS

| | | | |
|---|---|---|---|
| Re. 35,046 | 10/1995 | Hettinger et al. . | |
| 4,057,512 | 11/1977 | Vadovic et al. | 209/214 X |
| 4,359,379 | 11/1982 | Ushio et al. | 209/38 X |
| 4,406,773 | 9/1983 | Hettinger et al. . | |
| 4,482,450 | 11/1984 | Ushio et al. . | |
| 5,147,527 | 9/1992 | Hettinger | 208/113 X |
| 5,198,098 | 3/1993 | Hettinger . | |
| 5,393,412 | 2/1995 | Hettinger | 208/120 |
| 5,516,420 | 5/1996 | Henton | 208/113 X |

*Primary Examiner*—Tuan Nguyen

*Attorney, Agent, or Firm*—Richard C. Willson, J; Richard D. Stone

[57] ABSTRACT

Optimized utilization of combinations of fluid catalyst magnetic separator, classifier, and/or attriter can be used to achieve lower catalyst cost, and better catalyst activity and selectivity through control of metal-on-catalyst, particle size and particle size distribution. This process is especially useful when processing high metal-containing feedstocks. This provides a catalyst recovery unit (RCU™) ancillary to an FCC or similar unit.

3 Claims, 22 Drawing Sheets

COMBINATION MAGNETIC SEPARATION, CLASSIFICATION AND ATTRITION PROCESS FOR RENEWING AND RECOVERING PARTICULATES

This application is a divisional of U.S. Ser. No. 08/305,525 filed Sep. 13, 1994, now U.S. Pat. No. 5,635,747, which is itself a continuation-in-part application of U.S. Ser. No. 07/695,188, filed May 3, 1991, now U.S. Pat. No. 5,393,412.

BACKGROUND OF THE INVENTION

I. Field of the Invention

The present invention relates to the field of separation of catalysts and sorbents, generally classified in U.S. patent Class 208, subclass 120.

In conventional fluid bed cracking of hydrocarbon feedstocks, it is the practice, because of the rapid loss in catalyst activity and selectivity, to add fresh catalyst continuously or periodically, usually daily, to an equilibrium mixture of catalyst particles circulating in the system. If metals, such as nickel and vanadium, are present in the feedstock, they accumulate almost completely on the catalyst, thus drastically reducing its activity, producing more undesirable coke and hydrogen, and reducing selective conversion to gasoline. In such cases, catalyst replacement additions may have to rise significantly.

Fluid cracking catalysts generally consist of small microspherical particles varying in size from 10 to 150 microns and represent a highly dispersed mixture of catalyst particles, some present in the unit for as little as one day, others there for as long as 60–90 days or more. Because these particles are so small, no process has been available to remove old catalysts from new. Therefore, it is customary to withdraw 1 to 10% or more of the equilibrium catalyst containing all of these variously aged particles, just prior to addition of fresh catalyst particles, thus providing room for the incoming fresh "makeup" catalyst. Unfortunately, the equilibrium catalyst withdrawn itself contains, 1–10% of the catalyst added 2 days ago, 1–10% of the catalyst added 3 days ago, and so forth. Therefore, unfortunately a large proportion of the withdrawn catalyst represents very active catalyst, which is wasted.

Catalyst consumption can be high. The cost associated therewith, especially when high nickel and vanadium are present in any amount greater than, for example, 0.1 ppm in the feedstock can, therefore, be great. Depending on the level of metal content in feed and desired catalyst activity, tons of catalyst must he added daily. For example, the cost of a ton of catalyst at the point of introduction to the unit can be $2,000 or more. As a result, a unit consuming 20 tons/day of "makeup" catalyst would require expenditures each day of $40,000. For a unit processing 40,000 barrels/day (B/D) this would represent a processing cost of $1/B or 2.5 cents/gallon, for makeup catalyst cost alone.

In addition to "makeup" catalyst costs, an aged high nickel and vanadium-laden catalyst can also reduce yield of preferred liquid fuel products, such as gasoline and diesel fuel, and instead, produce more undesirable, less valuable products, such as dry gas and coke. Nickel and vanadium on catalyst also accelerate catalyst deactivation, thus further reducing operating profits, and reducing throughput capacity of the conversion unit.

II. Description of the Prior Art

Patents related to processing metal-laden catalyst feedstocks and involving magnetic separation, classification and attrition include U.S. Pat. No. 4,359,379 and U.S. Pat. No. 4,482,450 to Ushio.

"Magnetic Methods For The Treatment of Materials" by J. Svovoda published by Elsevier Science Publishing Company, Inc., New York (ISBNO-44-42811-9) Volume 8) discloses both theoretical equations describing separation by means of magnetic forces with the corresponding types of equipment that may be so employed. Specific reference at pages 135–137 is made to cross-belt magnetic separators and pages 144–149 refer to belt magnetic separators involving a permanent magnet roll separator, as well as pages 161–197 which refer to high gradient magnetic separators, all of which are efficient in separating magnetic particles. Svovoda teaches a number of magnetic separation techniques useful with this invention, including the preferred RERMS, HGMS and the drum-roller device.

Magnetic separation of catalyst is covered in U.S. Pat. No. 4,406,773 (1983) of W. P. Hettinger et.al, which prefers use of a high gradient magnetic field separator (HGMS) or a carrousel magnetic separator which uses multiple HGMS units to achieve selective separation.

RELATED APPLICATIONS

Pending application U.S. Ser. No. 07/332,079, now U.S. Pat. No. 5,147,527 (attorney docket 6324AUS) covers the concept of using a preferred device for magnetic separation.

U.S. Ser. No. 601,965, (Attorney docket 6375AUS), covers the discovery of specie which, when present in aged equilibrium catalyst, further improves separation due to its very high magnetic susceptibility.

Pending application U.S. Ser. No. 07/479,003, now U.S. Pat. No. 5,106,486 (Attorney docket 6345AUS) covers the concept of a "Magnetic Hook"™.

Another preferred material also makes an additive as per U.S. Ser. No. 602,455, now U.S. Pat. No. 5,188,098 filed Oct. 19, 1990 (Attorney docket 6369AUS).

It has been discovered that another family of additives all of which have very high magnetic properties can also be added as "Magnetic Hooks"™ per U.S. Ser. No. 332,079, now U.S. Pat. No. 5,147,527 filed Apr. 3, 1989 (Attorney docket 6324AUS).

The present invention solves at least two pressing problems:

Industry has long felt a need to selectively remove older catalyst from fresher catalyst in order to reduce catalyst addition rates while at the same time maintaining better activity, selectivity and unit performance. Because of the very small size of typical catalyst particles, billions of particles are involved, and mechanical separation has been nearly impossible even if one could rapidly identify by some means, as for example, color, which particles are old, and which are new.

This invention also accommodates the environmental restrictions on effluent particulates which have recently caused refiners and catalyst manufacturers to gradually increase particle size to insure effective removal by cyclones and baghouses to reduce particulate emissions. This size increase creates fluidization problems and reduces activity and selectivity. The closer size distribution provided by the invention avoids these problems by permitting lowering of average particle size.

SUMMARY OF THE INVENTION

I. General Statement of the Invention

According to this invention, a combination of a magnetic separator, a catalyst classifier, and/or a catalyst attriter which wears off the outer layers of catalyst, yields more active catalyst of lower metal content with closer control of average particle size, and narrows particle size distribution, providing improved fluidization properties and better activity and selectivity. The preferred "triangle" of these three components is most effective and is shown in FIG. 1.

The present invention comprises a multi-step process for recovering and reconditioning used metal-laden particulate, said process comprising:

(a) passing metal-containing particulate from a hydrocarbon conversion process through magnetic separator means to separate out high metal, low activity particulate;

(b) passing particulate through a particle size classifier means so as to separate out larger particles, contaminated with metal;

(c) passing at least a portion of said larger particles therefrom to attriting means wherein said larger particles are reduced in size and metal content, cleansed of fines in said classifier means, and returned to the process.

This invention introduces a new method of processing equilibrium catalysts, especially those contaminated by use with metal-laden feedstocks, reducing cost and enhancing hydrocarbon conversion.

The invention provides a new refinery unit ancillary to a hydrocarbon conversion (cracking, sorbent, etc.) unit. Like economizers, waste heat boilers, etc., this new "catalyst recovery unit" reduces costs and also pollutants.

This invention results from a number of observations on the undesirable properties of equilibrium catalyst and provides means by which to correct these properties.

Because catalyst ages with time in the hydrocarbon process, fresh catalyst must typically be added each day is to maintain operating performance. But because of an inability to separate old catalyst from new, new catalyst is undesirably removed with the older catalyst.

The preferred Rare Earth Roller Magnetic Separator (RERMS), also has been discovered to have a particle size separation capability, which capability has now been combined with other processes and innovations to provide this invention, a new way of recovering and rejuvenating spent or equilibrium cracking catalyst or sorbent. A rare earth drum roll separator may also be employed here, although it is not as effective in achieving separation due to less efficient centrifugal forces being manifested.

One of the unusual and surprising findings of this particle size separation effect is that to some extent, metal deposition, especially iron, and the related magnetic susceptibility is also inversely related to particle size and is contributing to this somewhat contradictory observation.

Following is an non-limiting theoretical explanation of how this probably comes about.

Assume metal deposition from a feedstock is dependent only on the exposed outer surface of all catalyst particles and the accumulation of metal on a given particle after a given time is proportional to surface only and not the weight. Because a small particle has a greater surface to volume than a large particle, and because the number of small particles per given weight of catalyst is larger; it is possible to estimate the relative amount of metal to be found on catalyst particles of varying size.

FIG. 4 shows the rate of buildup of metal as a function of time per unit of mass and particles of diameter $D_1$, compared with $D_2$ where $D_2=2D_1$. The rate of buildup would be ½ as rapid. (Note also Example 2.)

FIG. 2 shows the rate of metal buildup on catalyst per unit of time for the above particles as discussed.

For example, if after time $t_1$, a 40 micron diameter particle has 5,000 ppm of metal on it, an 80 micron particle would only have 2,500 ppm of metal on it, and a 120 micron particle 1,666 ppm.

Because metal content is proportional to t, feed rate & metal content being constant, in ½, the 40 micron particle will have 10,000 ppm of metal, the 30 micron particle 5,000 ppm of metal, and the 120 micron particle 3,300 ppm. See FIG. 3.

As a result, it will take three times as long for a 120 micron particle to buildup to the same metal level as a 40 micron particle, or 1½ times as long for a 120 micron particle as a 80 micron particle.

II. Utility of the Invention

The present invention, preferably without need for recycle for high voltages, dangerous effluents or chemicals, can recover for recycle catalyst worth many times investment costs, which is conventionally wasted, e.g. in FCC and RCCs process hydrocarbon conversion processes.

DESCRIPTION OF THE PREFERRED EMBODIMENTS

Figure 1B:
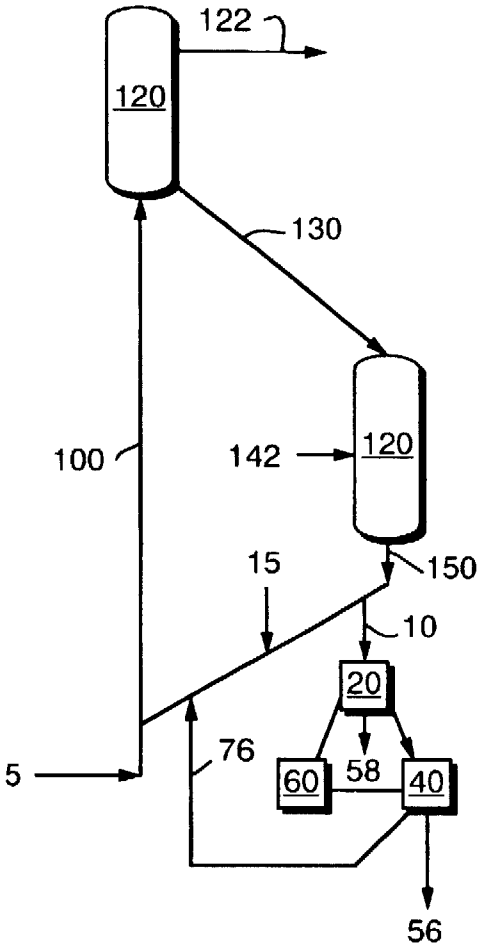
FIG. 1*b* shows the apparatus of FIG. 1 in place in a conventional hydrocarbon conversion unit receiving residual feed 5 into riser 100 where it is cracked and recovered in product recovery unit 120 outputting products 122 for further separation and processing, and outputting coked metal-laden catalyst 130 to regenerator 140 where coke is burned off with input air 142, and regenerated catalyst 150 is outputted, principally for return to riser 100. A portion of the equilibrium regenerated catalyst 10 is removed (periodically or continuously) and fresh makeup catalyst 15 is added to supplement recycled catalyst 76 from the catalyst recovery unit.

The invention will be understood by reference to the following illustrative Examples:

EXAMPLE 2A (Effect of Particle Size on Metal Build-up and Magnetic Susceptibility Xi)

Cuts of commercial catalysts are taken at 75 microns, 105 microns, and 150 microns, and assuming equal time in the unit, and the midway point as representative, i.e. 38 microns, 90 micron and 127 microns, then the metal content of the 90 micron particle will be 38/90 or 40% of the 38 micron particle. A quick check of the RCC catalyst will be 38/90= 40%, and for the 127 micron particle, 30% of the value for the 0–75 micron (38) cut. If we assume magnetic susceptibility is proportional to metal content, then it appears in the same ratio as metal content, namely, 100% 40%, and 30% respectively of the 38 micron particle.

To obtain support for this analysis, resid-cracking catalyst from Catlettsburg and FCC catalyst from Canton are separated into three fractions (simulating classifier 40) by screening with 150 and 200 mesh screens to give a 0–75 micron cut, a 75 to 104 micron cut, and a 104 to 150 micron cut.

TABLE 1

| | | $Xg \times 10^{-6}$ | % of Mag Susp. | | Second Predicted |
|---|---|---|---|---|---|
| Fraction | % | emu/gm | Actual | Predicted | Part. Size |
| 0–74 microns | 54 | 33 | 100 | 100 | 100 |
| 75–104 microns | 32 | 22 | 67 | 50 | 63 |
| Greater than 105 microns | 14 | 17 | 50 | 33 | 48 |

Table II shows the results on Canton sample 900115

TABLE 2

| | | $Xg \times 10^{-6}$ | % of Mag Susp. | | Second Predicted |
|---|---|---|---|---|---|
| Fraction | % | emu/gm | Actual | Predicted | Part. Size |
| 0–74 microns | 53 | 43 | 100 | 100 | 100 |
| 75–104 microns | 37 | 30 | 70 | 50 | 63 |
| Greater than 105 microns | 10 | 23 | 53 | 33 | 48 |

In view of the assumptions regarding average particle size, the distribution of magnetic susceptibility is strikingly close to predicted. If it is assumed that the 0–75 micron fraction is mainly 40–75 microns, and the midpoint 57, then the second column gives the predicted values, and the values approach theoretical. With this confirmation of the effect of particle size on metal pickup, as related to magnetic susceptibility, we can now begin to devise a more sophisticated process for metals control through magnetic separation, particle size separation, and particle size reduction.

The above data shows that metal level on a catalyst is in fact related to particle size, and therefore, metal reduction may also be achieved by classification. However, although coarse particles are, therefore, expected to gain much less metal as a function of time, and if metal content determines when a particle will have sufficient magnetic properties to be removed, it is apparent that large particles will be much older for the same metal content. It is also known and demonstrated by Zenn and Othmer, Fluidization and Fluid Particle Systems, Reinhold Chemical Engineering Services, 1966, that optimum particle size for fluid bed catalytic cracking resides in the 40–80 micron range. If coarser particles tend to preferentially remain, poorer fluidization begins to appear, and a need arises to control this increase in particle size. Also, in view of environmental concerns related to particulate emissions from catalytic cracking, catalyst manufacturers have attempted to reduce this problem by producing coarser catalyst, thus also causing an increase in average particle size, which adds to this problem of ever increasing particle size growth in an operating unit, especially when running on metal-laden feedstock, and especially when utilizing magnetic separation.

Today's catalyst is also designed to resist attrition which produces particulate fines, and this also contributes to accumulation of coarse catalyst.

Another factor is the accessibility of the catalyst to the oil and during the short contact times of today's riser progressive flow reactor, where contact times between oil and catalyst are as low as one second or less. For a given catalyst to oil weight ratio within the usual 4–10 or more range, a catalyst of a given diameter has three times as much outer peripheral surface area, and 27 times as many particles per ton as compared with a catalyst particle having three times that diameter. For example, a 50 micron particle has two times as much outer exposed entrance surface area and eight times as many particles per ton as compared with a 100 micron particle. Obviously, the opportunity for catalytic action is much greater for the small 11 particle, especially when much of the feedstock boils above the temperature of the incoming catalyst, and must flow as a liquid into an internal catalytic site. Example #5 demonstrates the particle size effect on selectivity.

Figure 18:
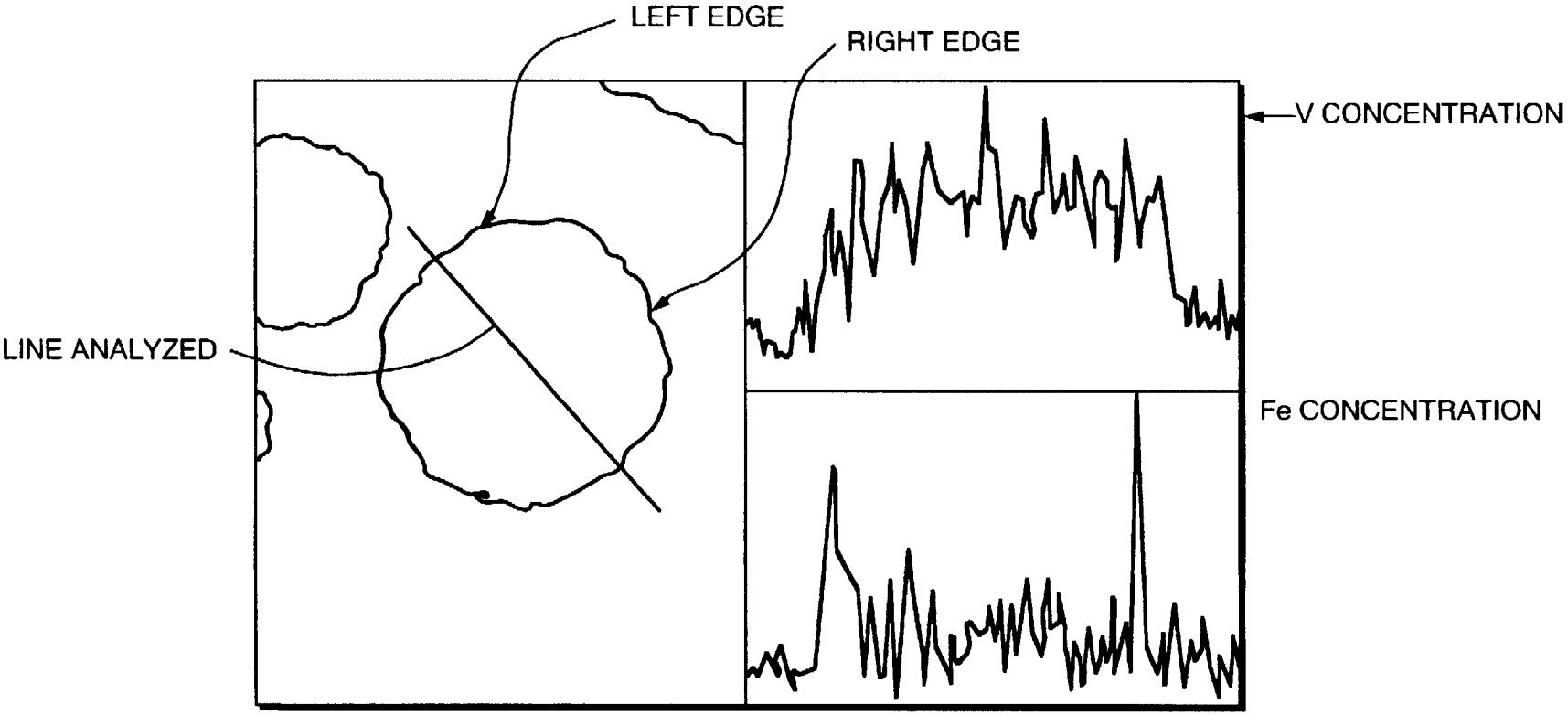
FIG. 18 is a plot obtained on a high resolution energy dispersion x-ray instrument showing the high Fe concentration on the outer peripheral surface of the particle and the relatively uniform V concentration across the particle, confirming that iron, as well as nickel remain on the outside of the particle as shown in FIG. 16.

With regard to metal deposition of nickel, vanadium, and iron, it is well known that under regenerator conditions, unless care is taken to keep vanadium in a plus 4 or plus 3 valence as described in our U.S. Pat. No. 4,377,470 (Attorney docket 6117BUS), it tends to migrate as $V_2O_5$ throughout the catalyst particles, destroying valuable molecular sieve as it proceeds. However, our studies by means of Energy Dispersive X-ray Fluorescence as described in Example 5 and FIG. 18 show that iron is clearly deposited on the outer rim of the catalyst particle.

The present invention is a new three-legged (triangle) process which selectively removes very fine particles, high in metals and low in catalyst performance, by classification and/or magnetic separation, and to separate coarse catalyst also by either magnetic separation or classification or both and grinds coarse catalyst to reduce particle size while at the same time thus selectively removes iron and nickel from the outer shell.

EXAMPLE 1

(The Invention)

Figure 5:
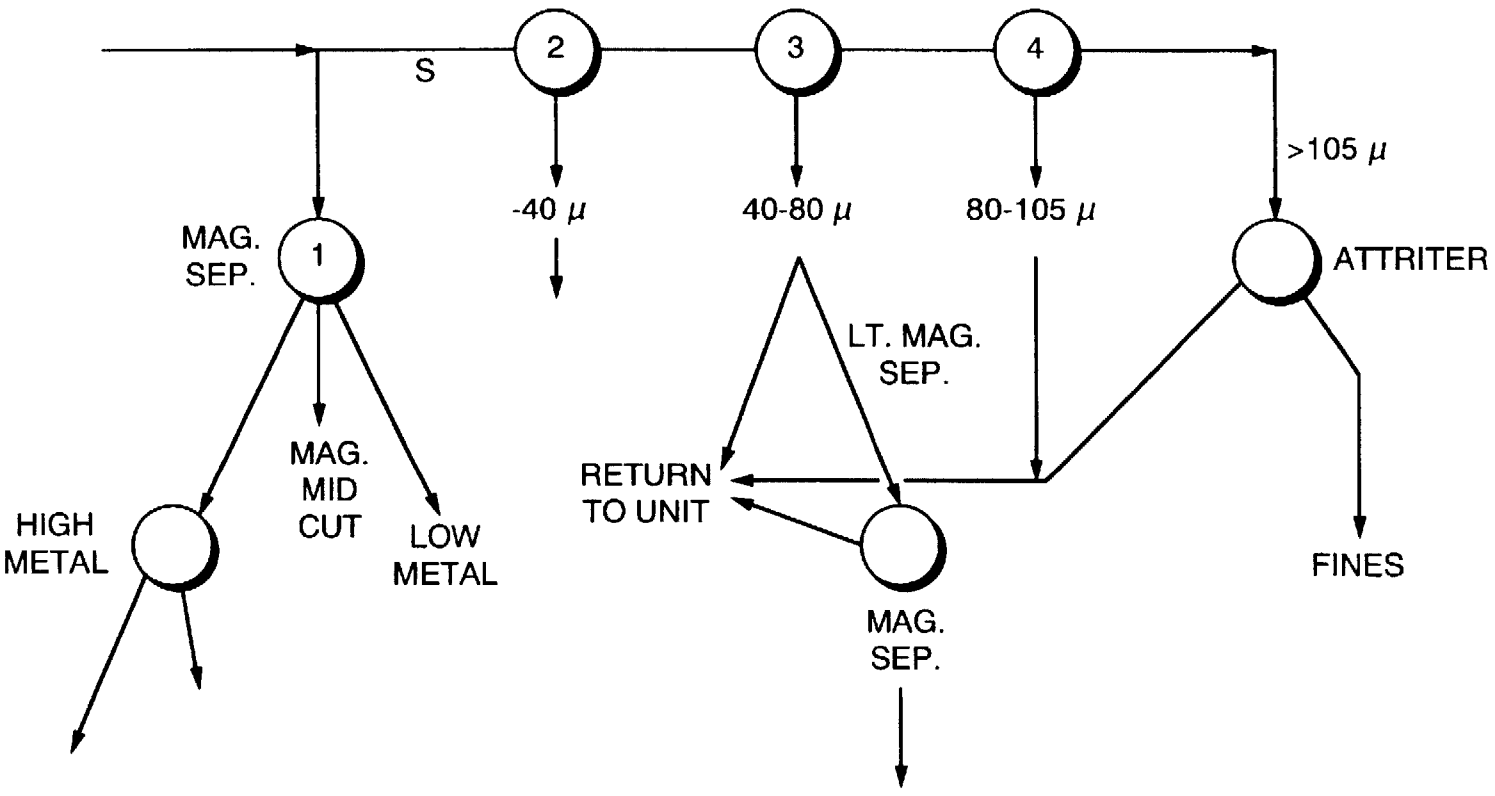
FIG. 5 shows schematically a flow sheet for various particles moving through a series of magnetic separation and classification steps. These steps may be accomplished by multiple magnetic separators and/or classifiers in cascade or similar arrangement, or may represent internal recycles repeatedly back through a single magnetic separator or classifier. The end result is to provide particles beneficiated in metals for metals recovery or for discarding to suitable solid waste landfill, or other disposal, plus valuable optimum size, lower-metal content catalyst for recycle to the hydrocarbon conversion unit.

Referring to FIG. 1, high metal equilibrium catalyst 10 is introduced in either continuous or batch manner to the process. In one example, not necessarily limiting, catalyst is sent to a magnetic separator 20 where a high-magnetic cut is taken and discarded or sent for chemical reclamation or reactivation 58. This fraction can be anywhere between 1 and 30% by weight or more. A second cut 76 representing a major portion of the catalyst, now higher in activity and lower in metals than equilibrium catalyst, perhaps as low as 20% and as high as 95%, is returned to the unit via 76 or passed through classifier 40 and returned to the unit via 76. Coarse catalyst containing catalyst greater than 104 microns (150 mesh sieve) amounting to 1–20% or more, is sent via 24 to the classifier 40 for enrichment of the coarse fraction. The collected fines can also be returned to the unit or discarded via 56. The coarse fraction 52 from classification is then sent to the attrition unit 60 which reduces it in size, removes the outer shell of metal, and the finished product also returns to the unit. For catalyst with high loadings of fines, the process can be reversed, with equilibrium catalyst going to the classifier 40 to remove fines and on through 54 to the magnetic separator, where the above process is repeated. A catalyst very high in a coarse fraction, can be sent to the classifier 40 first with coarse catalyst being sent via 52 to the attriter 60 and the second fraction 54 being sent on to magnetic separation. Where extremely coarse catalyst is encountered, or where equilibrium catalyst is purchased to add to virgin catalyst, and if this catalyst is very coarse, it can be sent to the attriter 60 first. FIG. 5 shows several possible flow schemes.

This invention now provides a new process which allows a refiner many options in his objective of minimizing catalyst cost while optimizing catalyst size, activity and selectivity. By judicious use of this combination process which can operate either in batch or continuous operation, the refiner is in a position to minimize catalyst cost, control metal and catalyst particle size all at the same time and very inexpensively.

EXAMPLE 2B (Coarse Particle Size Removal by Magnetic Separation)

Equilibrium RCC catalyst was taken and subjected to coarse particle size separation by two methods; Rare Earth Roller (RERMS); and High Gradient Magnetic Separation (HGMS).

Figure 6:
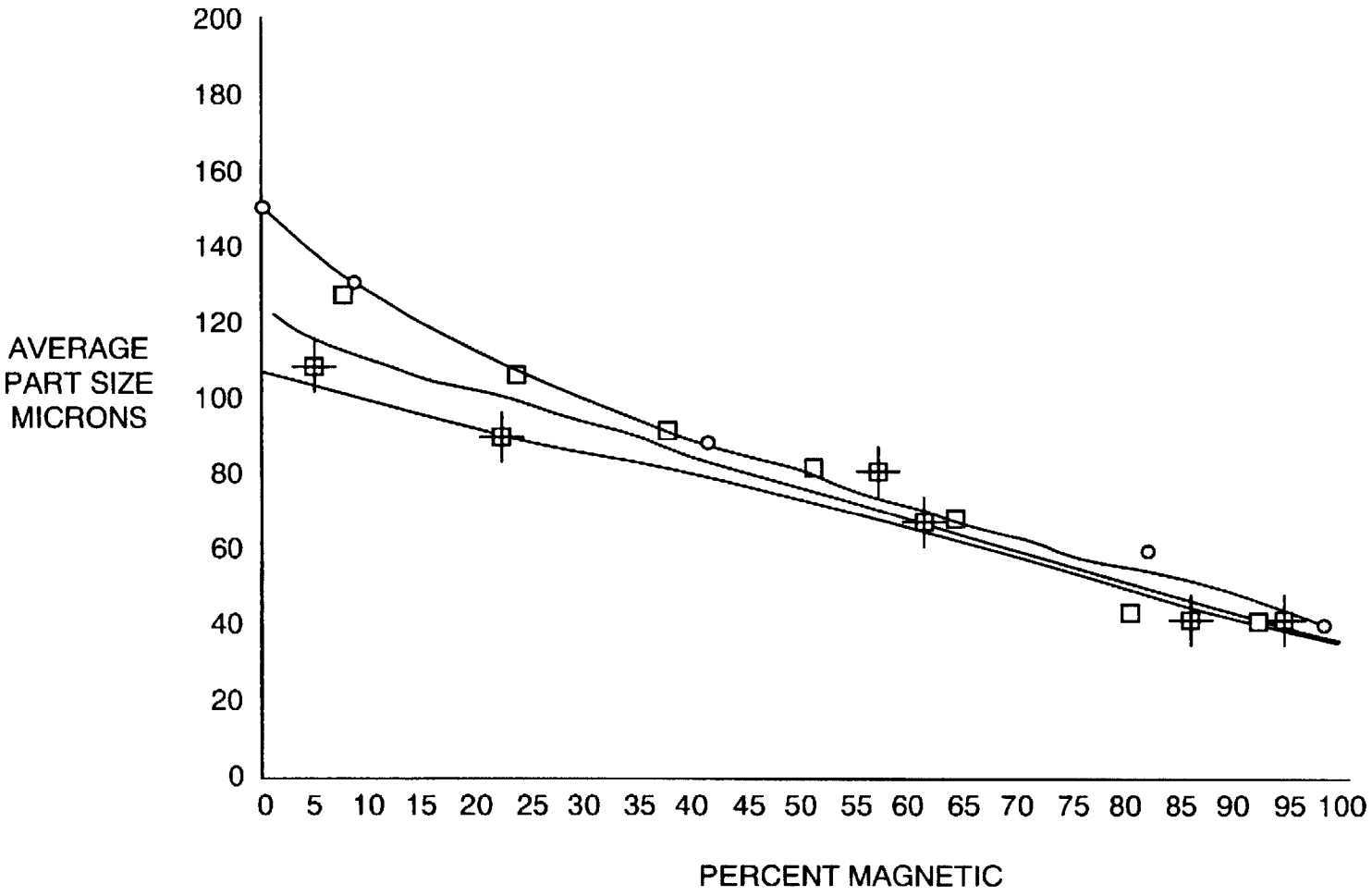
FIG. 6 is a plot of average particle size in microns versus percent magnetic for three separation techniques: sieve separation; magnetic separation with most magnetic off first; and, less desirably, magnetic separation with low magnetic off first.

In RERMS, separation is made with the most magnetic fraction taken off first, followed by as many as six additional magnetic cuts, each one lower in magnetic susceptibility than the previous-cut. FIG. 6 shows how average particle size in microns varies for each cut. It is apparent that the more magnetic the particle, the smaller its average particle size. How this relationship between metal content, magnetic susceptibility, and particle size manifests itself was described in an earlier section.

Figure 7:
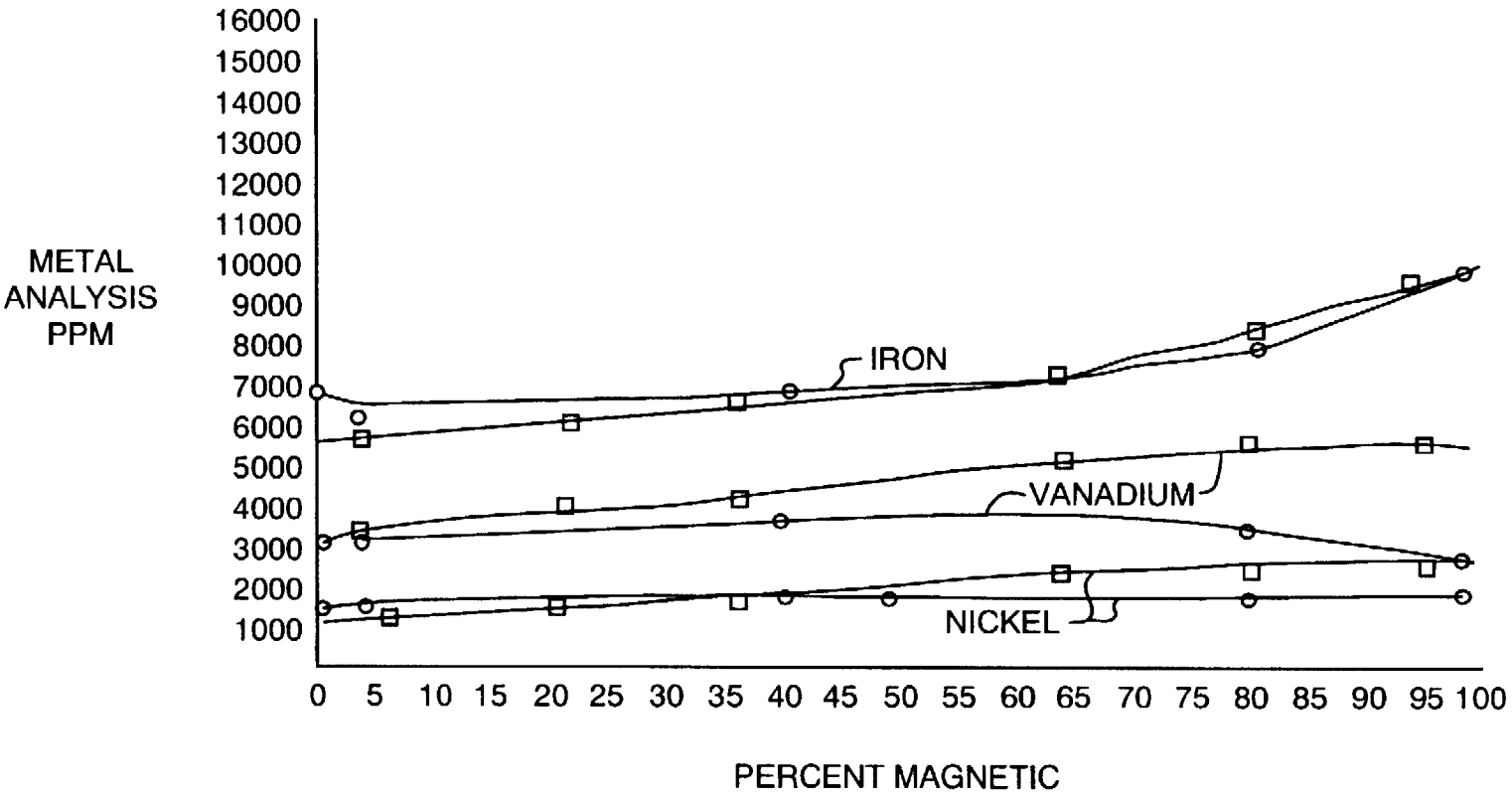
FIG. 7 plots metal-on-catalyst, ppm metal versus percent magnetic for iron, vanadium, and nickel, respectively, and shows separate curves for sieve separation and for magnetic separation (RERMS). RCC® Process resid cracking catalyst is used obtaining the results of FIGS. 6 through 12.
Figure 8:
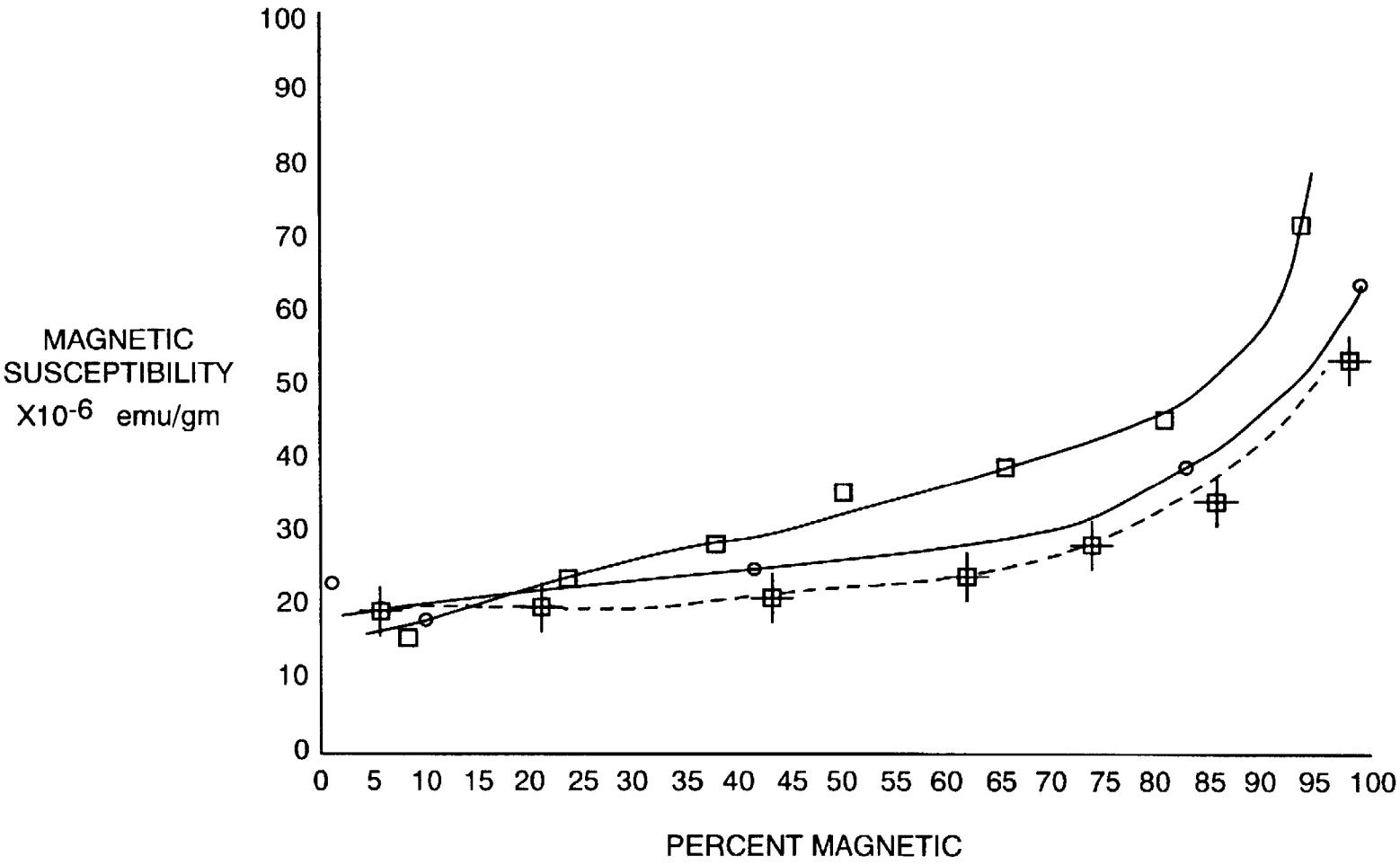
FIG. 8 shows, for the same sample as in FIGS. 6–13, magnetic susceptibility (EMU/gm) versus percent magnetic, and compares sieve separation with magnetic separation-high mag off first and magnetic separation-low mag off first.
Figure 9:
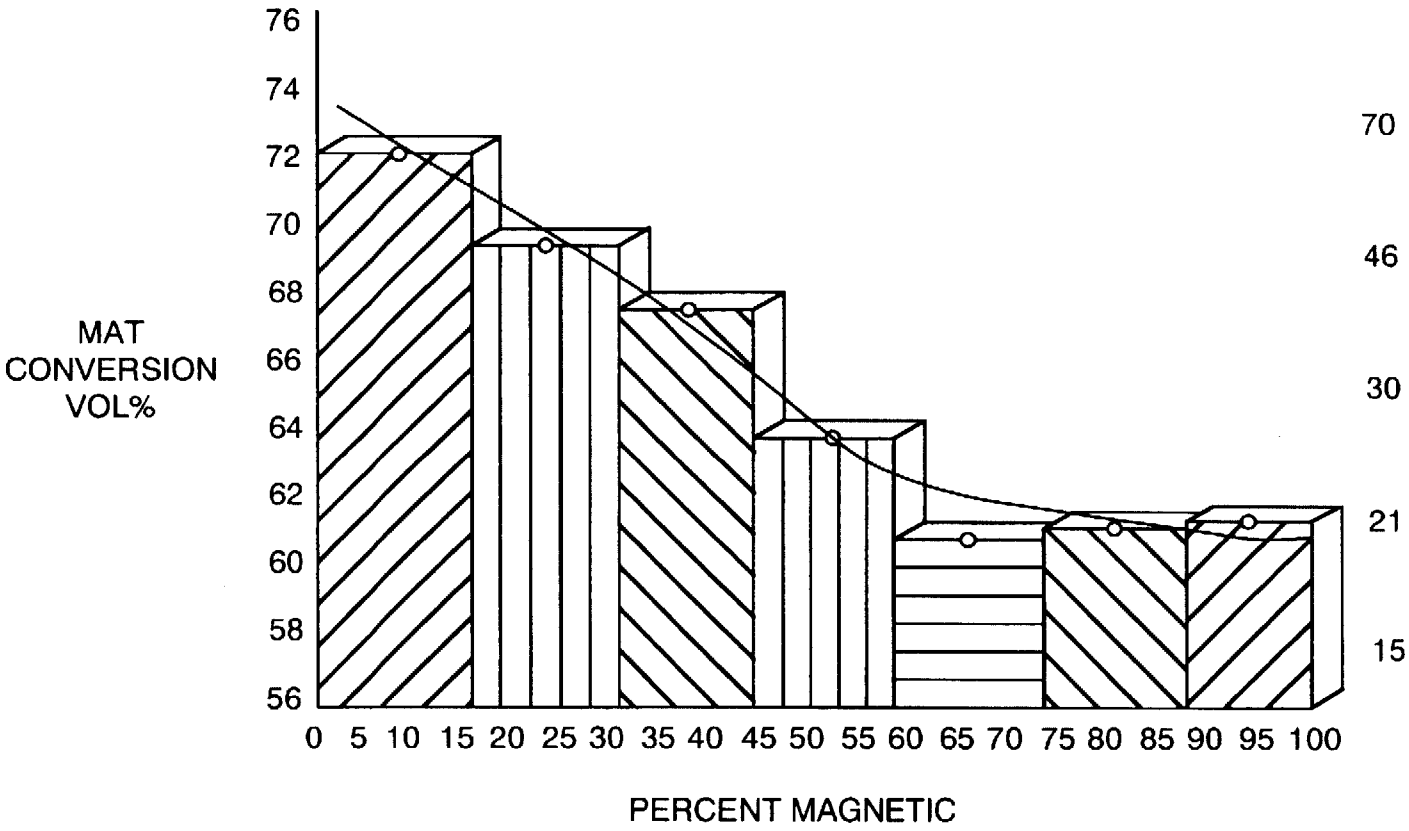
FIG. 9 shows for the same sample (preferred high mag off first), seven fractions from the RERMS versus their MAT conversion (volume %).

If more than one cut is desired, the Rare Earth Roller can be employed in reverse manner by taking off the least magnetic portion first followed by taking off increasingly magnetic particles to achieve similar separation. However, as shown in FIG. 6, if more than one cut is taken, reverse separation is not necessarily as effective. This is confirmed not only by particle size analysis as shown in FIG. 6, but also confirmed by chemical analysis and magnetic susceptibility of these cuts as shown in FIGS. 7 and 8. FIG. 9 shows that for the RERMS method, catalyst MAT vol. % conversion, a key catalytic property and an objective of magnetic separation, is highest for the lowest magnetic fraction. In this experiment, the seven cuts are shown as block diagrams and a single point represents the midpoint of this cut. For all further presentations, each graph was derived from such cuts, with only the location of the midpoint shown for ease of presentation.

Figure 10:
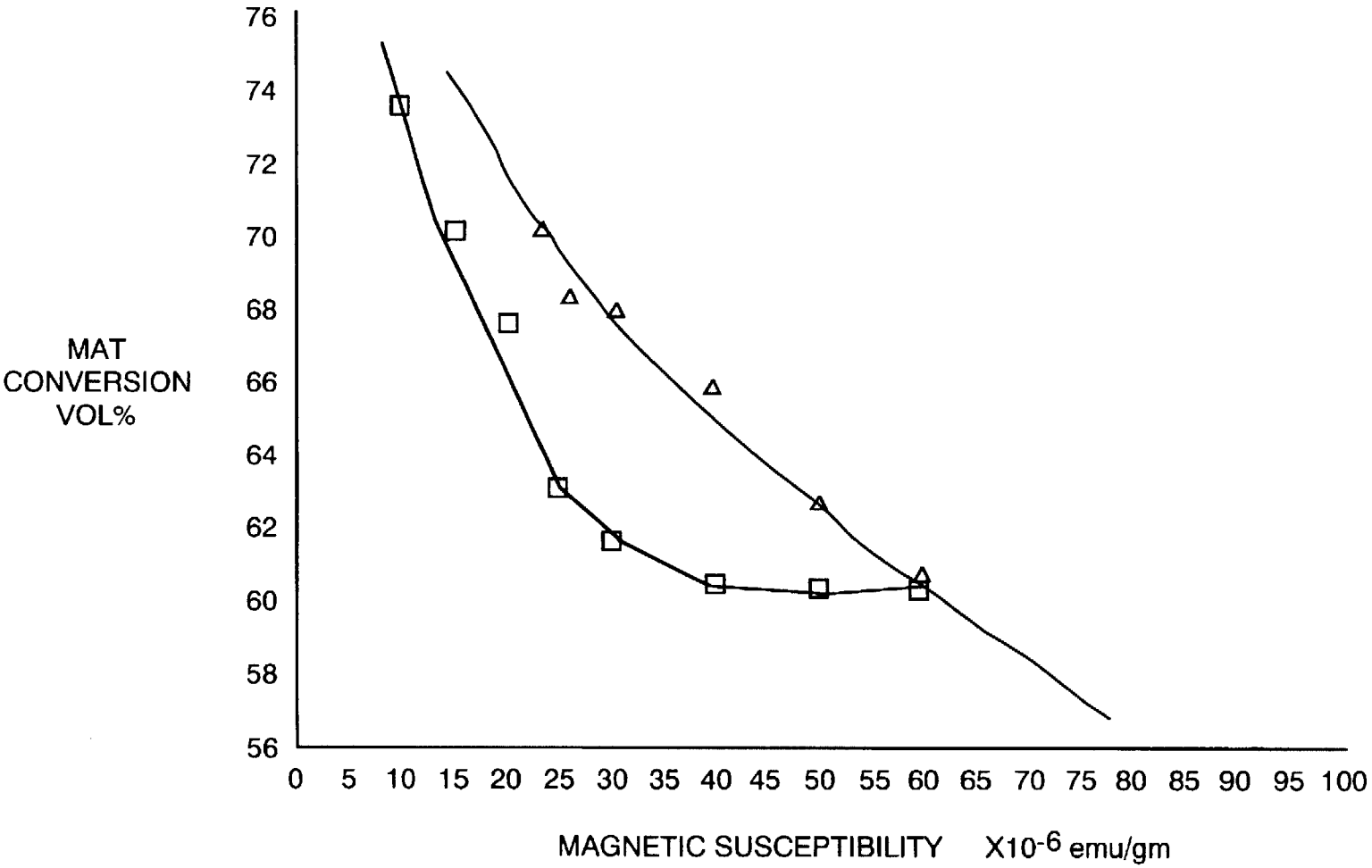
FIG. 10 is a plot for the same sample of magnetic susceptibility for fractions separated by RERMS plotting magnetic susceptibility versus MAT conversion, and comparing dramatically the higher MAT achieved in the earlier fractions (lower magnetic susceptibility fractions) by using the high mag off first technique, which is preferred for the invention.

The relationship between MAT activity and magnetic susceptibility is clearly shown in FIG. 10 where MAT conversion is shown to relate inversely to magnetic susceptibility. I.e., the lower the magnetic susceptibility, the higher the catalyst activity or MAT conversion. Note how much higher MAT conversion extends for the preferred high magnetic cut off first.

Figure 11:
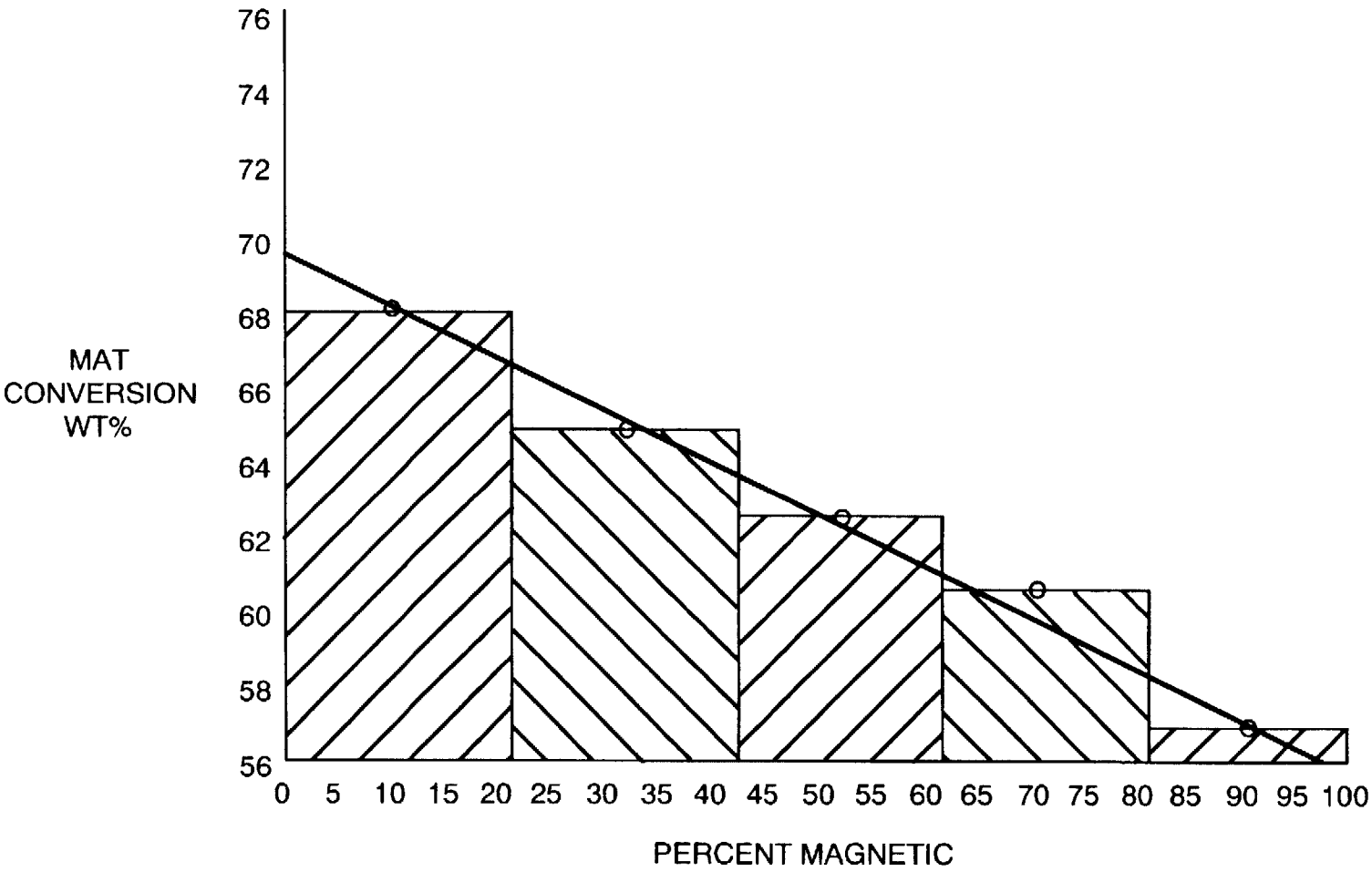
FIG. 11 plots for the same sample, but separated by high gradient magnetic separator (HGMS), MIAT conversion versus percent magnetic for five fractions and demonstrates that the most magnetic 20% is 11 points lower in MAT than is the least magnetic, so that discarding the most magnetic fraction (20%) can sharply increase the average activity of the remaining catalyst recycled to the conversion unit.
Figure 12:
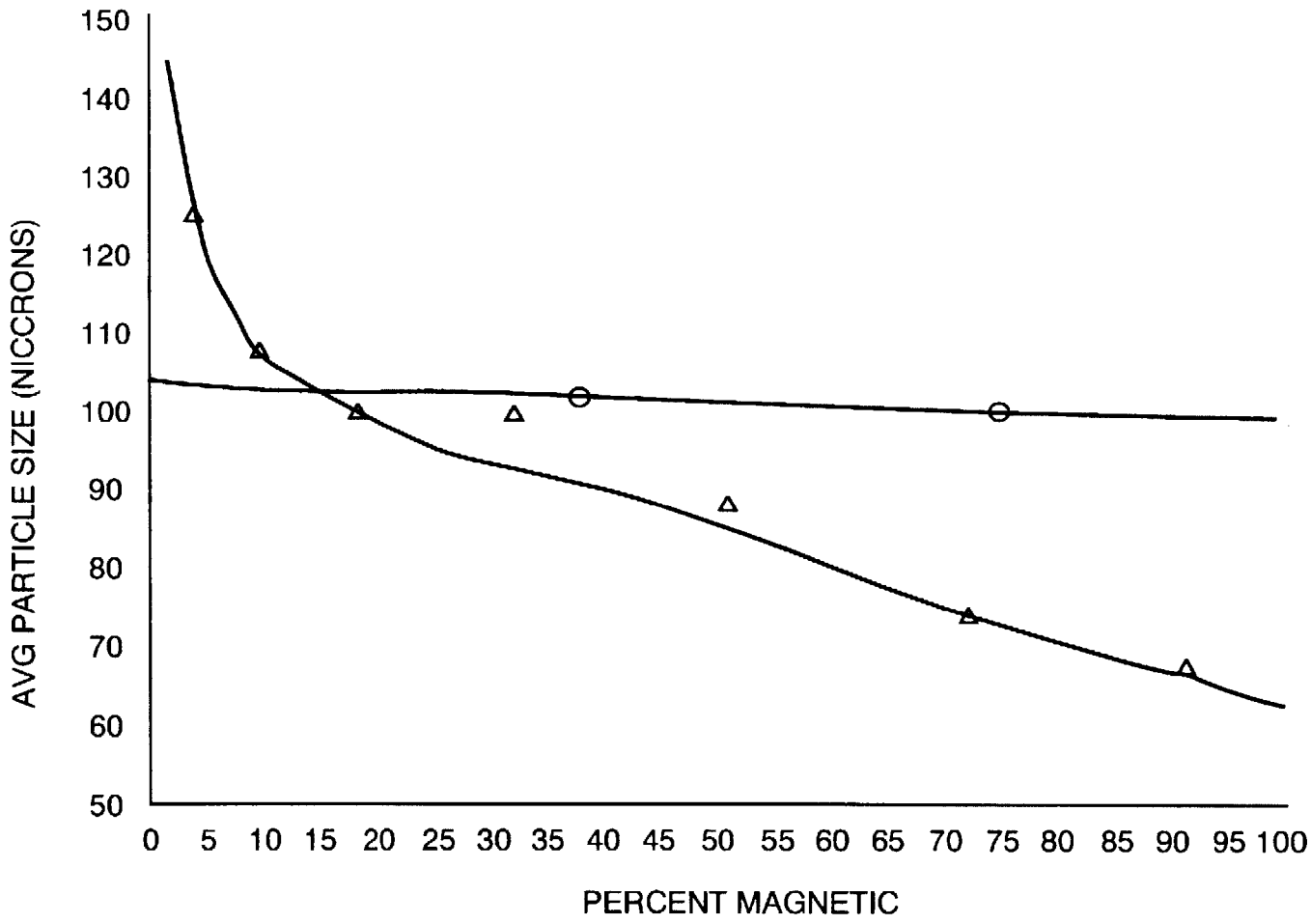
FIG. 12 plots percent magnetic versus particle size (microns), and compares high gradient magnetic separation (relatively insensitive to particle size) with rare earth roller magnetic separation (RERMS) which is dramatically capable of separating particles by particle diameter.

FIG. 11 shows that HGMS can also be used i:o achieve a similar increase in MAT activity as a result of separation, but other studies show that the HGMS method is not as effective in using magnetic separation to remove coarse particles. FIG. 12 shows a very slight sensitivity to particle size in the HGMS method as compared with the RERMS size sensitivity of the method. In the RERMS method, it appears that magnetic properties are balanced against gravitational and centrifugal forces, which are related to particle size; not the case in the HGMS method.

Examples 2A and 2B show that not only can magnetic separation create fractions of high and low catalytic: activity, but the RERMS can also separate particles by size, an important advantage of preferred embodiments of this invention.

EXAMPLE 3

(Sieve or Screening Separation of Equilibrium Catalyst to Control Particle Size Distribution and Metal Content)

This example demonstrates that metal content, especially iron, as well as magnetic properties of spent, cracking catalyst as previously shown, are also related to particle size.

Reverse separation by screens or sieves, shows that separation by particle size also leads to differences in metal and magnetic properties, as also seen in FIGS. 7, 8, and 9. Unfortunately, clean, close separation of particles by size is a theoretical ideal, but in practice, a very difficult and expensive operation. The data show there are changes in magnetic susceptibility, and to a certain extent, chemical composition, which is desirable. But screening or classification is still not effective in terms of the critical measure, namely MAT activity, although other Examples show that economically acceptable classification methods presently available on a commercial scale, can enable separation on a particle size basis. However, attrition, the third leg of this invention (described in Example 6), can also be used for particle size and metal control of circulating catalyst, allowing partial recovery of the significant coarse fraction, which otherwise would have to be discarded, or at least diluted by large addition of costly fresh catalyst.

Figure 13:
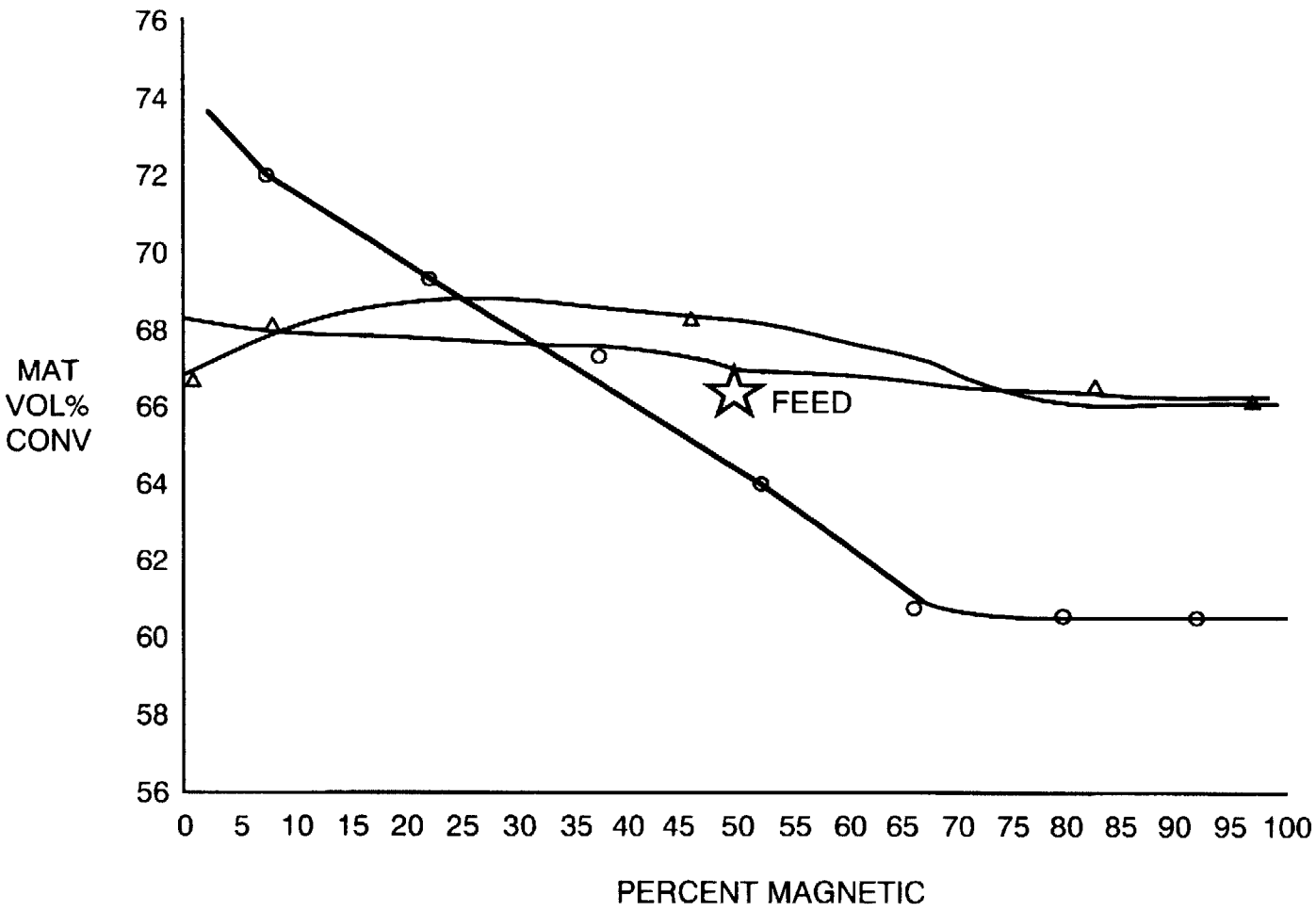
FIG. 13 is a plot of percent magnetic versus MAT (volume % conversion) and demonstrates dramatically the advantage of RERMS magnetic separation as compared to separation by sieve. Note that dropping off the most magnetic 35% of the catalyst will sharply increase the average MAT of the remainder recycled to the hydrocarbon conversion unit, whereas dropping the last 35% of the sieve separated catalyst will not.

FIG. 13 shows that particle size separation even by "ideal" sieve separation does not give any meaningful change in catalyst activity, and therefore, even if an "ideal" separation could be made in a practical manner (none to my knowledge is presently available), the desired change in activity accomplished by magnetic separation, would not result. FIG. 7 also shows that although beneficiation in iron analysis with "ideal" sieve separation is partially effective, sieving is not effective for nickel and vanadium as both pass through a maximum in the 50% fraction.

Tables 3, 4, and 5 provide actual data from which most of these curves were derived. These data show that particle size separation in an "ideal" situation, does achieve some mild chemical separation, but not nearly enough to be useful commercially and certainly not from an activity change standpoint. However, by a somewhat less exacting, less costly, commercially available classification method to be described in Example 4, it is possible to separate, to some extent, satisfactory for our process, fine and coarse fractions, which can be profitably utilized in this invention.

TABLE 3

MAGNETIC SEPARATION RERMS METHOD - HIGH MAG OFF FIRST
Equilibrium RCC Catalyst

| Wt. % | Magnetic Sample # | Average Particle Size Range Microns | Mag Suscept. $X_g \times 10^{-6}$ emu/gm | Fe ppm | Ni ppm | V ppm |
|---|---|---|---|---|---|---|
| 13.8 | $M_1$ | 40 | 72 | 9160 | 2545 | 5191 |
| 14.0 | $M_2$ | 42 | 44 | 7910 | 2386 | 5193 |
| 15.2 | $M_3$ | 70 | 39 | 7200 | 2192 | 5085 |
| 14.1 | $M_4$ | 80 | 34 | — | — | — |
| 12.6 | $M_5$ | 90 | 28 | 6080 | 1565 | 3996 |
| 14.9 | $M_6$ | 105 | 22 | 5900 | 1409 | 3784 |
| 16.3 | $NM_6$ | 125 | 15 | 5700 | 1113 | 3212 |

TABLE 4

MAGNETIC SEPARATION RERMS METHOD - LEAST MAGNETIC OFF FIRST
Equilibrium RCC Catalyst

| Wt. % | Magnetic Sample # | Average Particle Size Range Microns | Mag Suscept. $X_g \times 10^{-6}$ emu/gm | Iron ppm | Ni ppm | V ppm |
|---|---|---|---|---|---|---|
| 10.8 | $M_6$ | 40 | 55 | 8900 | 2614 | 5354 |
| 9.0 | $NM_6$ | 40 | 33 | 8100 | 2323 | 5181 |
| 12.0 | $NM_5$ | 50 | 29 | — | — | — |
| 15.0 | $NM_4$ | 70 | 24 | — | — | — |
| 19.8 | $NM_3$ | 80 | 20 | — | — | — |
| 23.6 | $NM_2$ | 90 | 19 | 6600 | 1691 | 4292 |
| 9.8 | $NM_1$ | 105 | 19 | 6800 | 1718 | 4272 |

TABLE 5

SIEVE SEPARATION
Equilibrium RCC Catalyst

| Wt. % | Sieve Size | Average Particle Size Range Microns | Mag Suscept. $X_g \times 10^{-6}$ emu/gm | Iron ppm | Ni ppm | V ppm |
|---|---|---|---|---|---|---|
| 2.5 | on 100 | +150 | 24 | 6430 | 1358 | 2857 |
| 13.6 | on 150 | +130 | 17 | 6011 | 1440 | 2985 |
| 51.8 | on 200 | +90 | 25 | 6511 | 1602 | 3243 |
| 27.5 | on 325 | +60 | 38 | 7619 | 1571 | 3061 |
| 4.2 | thru 325 | −40 | 63 | 9506 | 1541 | 2882 |

Example 28, however, shows that magnetic separation can also be effectively utilized to achieve particle size separations, including fine and coarse cuts. Why the "ideal"

sieve separation, yielding crisp particle size fractions does not give the equivalent chemical and MAT activity separations as does magnetic separation, is not yet clear. However, this inability to give a theoretical explanation, should not be construed as inhibiting the practical application of this invention.

Figure 14:
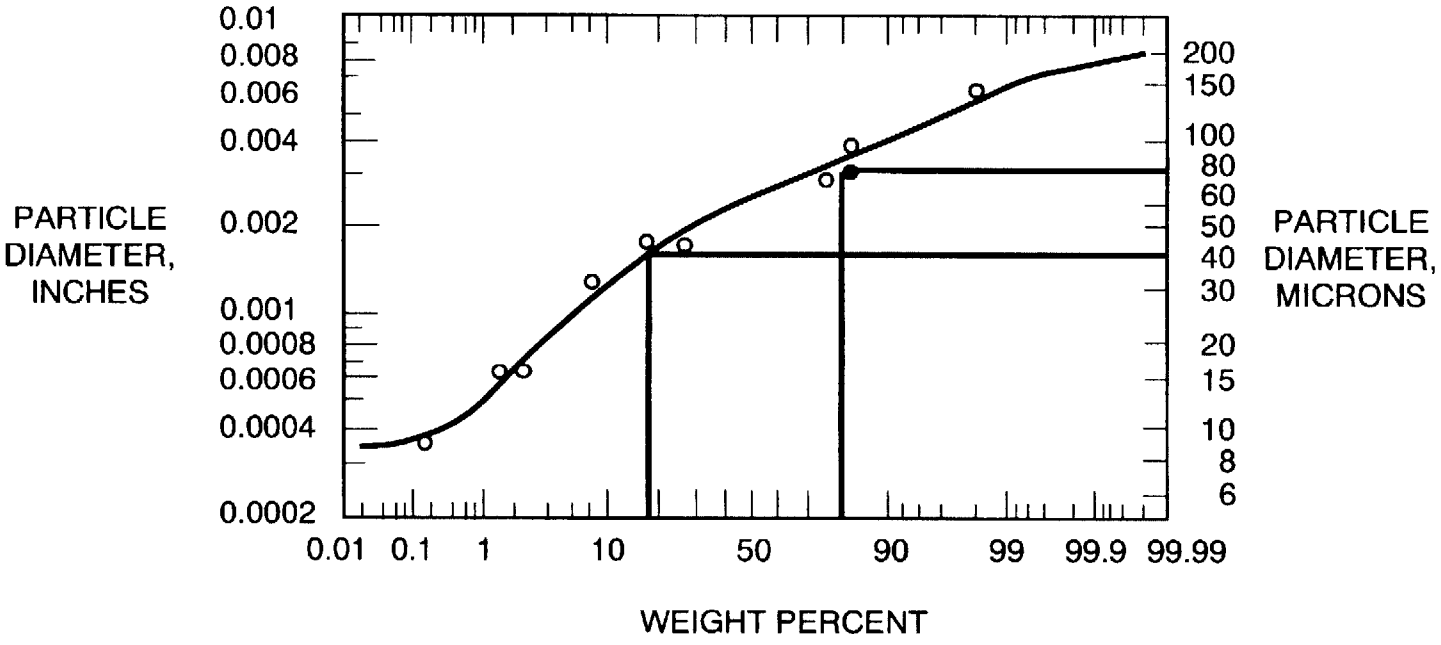
FIG. 14 is a plot from Zenn and Othmer, Fluidization and Fluid Particle Systems, Reinhold Chemical Engineering Services (1966), page 251 showing the particle size analysis of a typical FCC catalyst in inches diameter and microns diameter versus cumulative percent under.

This Example 3 does demonstrate, however, that removal of fines (by "ideal" sieve separation, and commercially by classification), offers a supplemental means to remove metals and fines as well. This invention provides, by a combination of three operations; magnetic separation; mechanical classification for removal of both fines (–40 microns) and coarse (+104 micron particles) sequentially; and attrition of coarse catalyst particles from either process to a lower particle size, closer size distribution, lower metal content, and increased catalyst activity particle. It provides a preferred high activity, highly fluidizable and high performing catalyst with particle size generally falling in the 30–105 micron and preferably 40–80 micron range. This Size range is considered the ideal particle distribution for FCC and RCC® operation in terms of activity, selectivity, and fluidizability. See FIG. 14.

EXAMPLE 4

(Mechanical Method of Obtaining Classification and Removal of Fine Particle Size Fractions)

This example demonstrates the availability of equipment for classifier 40 which can separate or remove fines and therefore metal from equilibrium catalyst.

Classifiers for sharp separation of particles (as obtained by sieve separation) -of varying size and size distribution in the 5–200 micron range are not readily available, and where available, are of borderline effectiveness, and are costly to operate and of low capacity. A Buell (G.E.) Classifier was evaluated and found to be inefficient.

Figure 15:
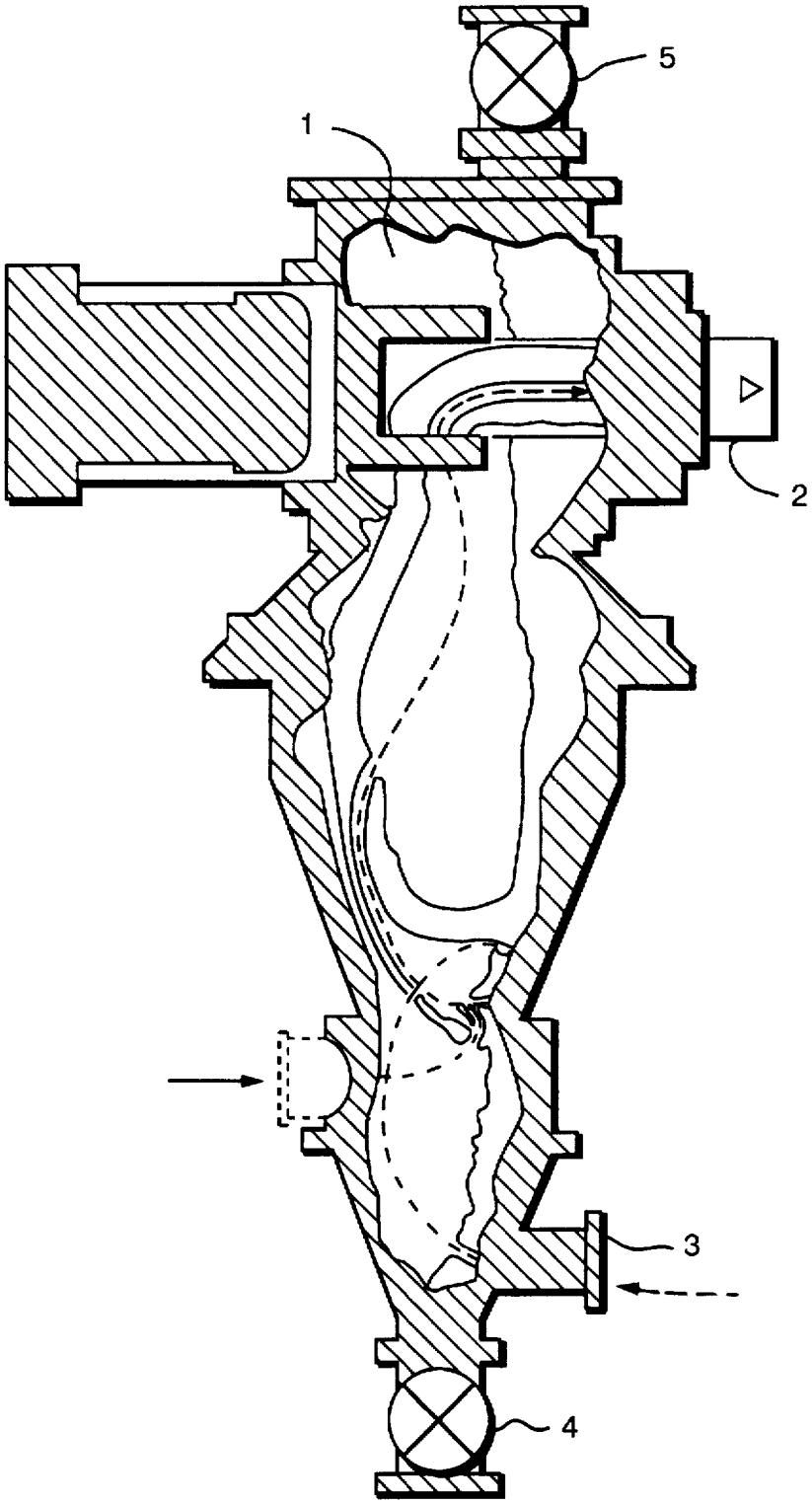
FIG. 15 is a schematic diagram of the preferred alpine Turboplex ATP200 for use with the invention. Additional literature and details are available from the manufacturer.

In this Example, a preferred Turboplex 200 ATP (Alpine Turbo-Plex) classifier (see FIG. 15), an intermediate size unit of a family of larger ATP classifiers from Micron Powders, Inc. of Summit, N.J., is utilized for fine particle separation.

Twenty-six pounds of equilibrium RCC catalyst, 72% of which passes through 140 mesh sieve is fed in two minutes, 45 seconds to a 200 ATP Turbo-Plex separator operating at 1,000 rpm with blower air of 730 cubic feet per minute (CFM) and at a rate of 621 pounds/hour to produce six pounds of fines (23 wt. %) 100% of which passes through a 140 mesh sieve and 77 wt. % of average particle size greater than the feed catalyst. This coarser fraction is then processed much more efficiently on the magnetic separator (which reportedly, does not operate well on very fine particles). Thus, this example demonstrates that fines with composition approaching that shown in FIG. 6 for 77 wt % recovery of coarse particles (APS of 90 microns at 39% magnetic;:) and 23 wt % recovery of fine particles (APS of 50 microns at 89% magnetics) respectively as compared to sieve separation, are removed from equilibrium catalyst for disposal, thus reducing the load on the magnetic separator. This example demonstrates the operability of one leg of the three-legged magnetic separation 20, classification 40, and attrition 60 process describe: here and shown in FIG. 1.

EXAMPLE 5

(Utilizing Classification to Remove Coarse Particle Size Fractions for Particle Size Reduction by Attrition)

This example demonstrates use of a commercial classifier for removing coarse catalyst larger than 104 microns in diameter.

Two hundred and fifty pounds of resid-cracking equilibrium catalyst with an APS of 84 microns is subjected to classification on the previously described 200 ATP Alpine Turboplex Classifier to remove a coarse fraction representing 15 wt. % with an APS of 114 microns and a remaining fraction representing 85% with an APS of 74 microns. The magnetic susceptibility of the equilibrium catalyst is $20.8\times10^{-6}$ emu/gm., while the 15% coarse fraction has a magnetic susceptibility of $12.7\times10^{-6}$ emu/gm., and the fines have a magnetic susceptibility of $22.7\times10^{-6}$ emu/gm. Table 6 shows the particle size analysis and magnetic susceptibility of the feedstock and the two fractions. These runs are made in 37 minutes, 20 seconds at a feed rate of 321 pounds/hour at an RPM of 712 at a total air flow of 706 CFM.

TABLE 6

| Yield | Feed | Wt. % 85 Fines | Wt. % 15 Coarse |
|---|---|---|---|
| Wt. % +104 microns (140 mesh) | 22 | 14 | 68 |
| Mag Suscept $\times 10^{-6}$ emu/gm | 20.7 | 22.7 | 12.7 |

The result, while showing some overlap of particle size, shows a yield of a coarse fraction containing over 68 wt. % of coarse material greater than 104 microns, (140 mesh) while producing 85 wt. % of product only 14 wt. % of which is greater than 104 microns (140 mesh). Theoretically, a second pass of this coarse first pass product, although greatly increasing cost, could yield product of which almost 90% should be greater than 104 microns. Note that coarse classification does also serve to split the feed into a higher and lower magnetic susceptibility, thus confirming that classification (even if not at theoretical or "ideal" level for sieving), does generate an enriched fraction of 104-micron-plus particles and a lesser content of these particles in a second fraction, and because of this separation, classification does also show some enrichment of metals in one fraction and reduction of metal levels in the other and thereby magnetic susceptibility, as shown in FIG. 8.

EXAMPLE 6

(Attrition Grinding of Coarse Catalyst to Lower Particle Size and Nickel and Iron Content, and to Raise Catalyst Activity)

Figure 16:
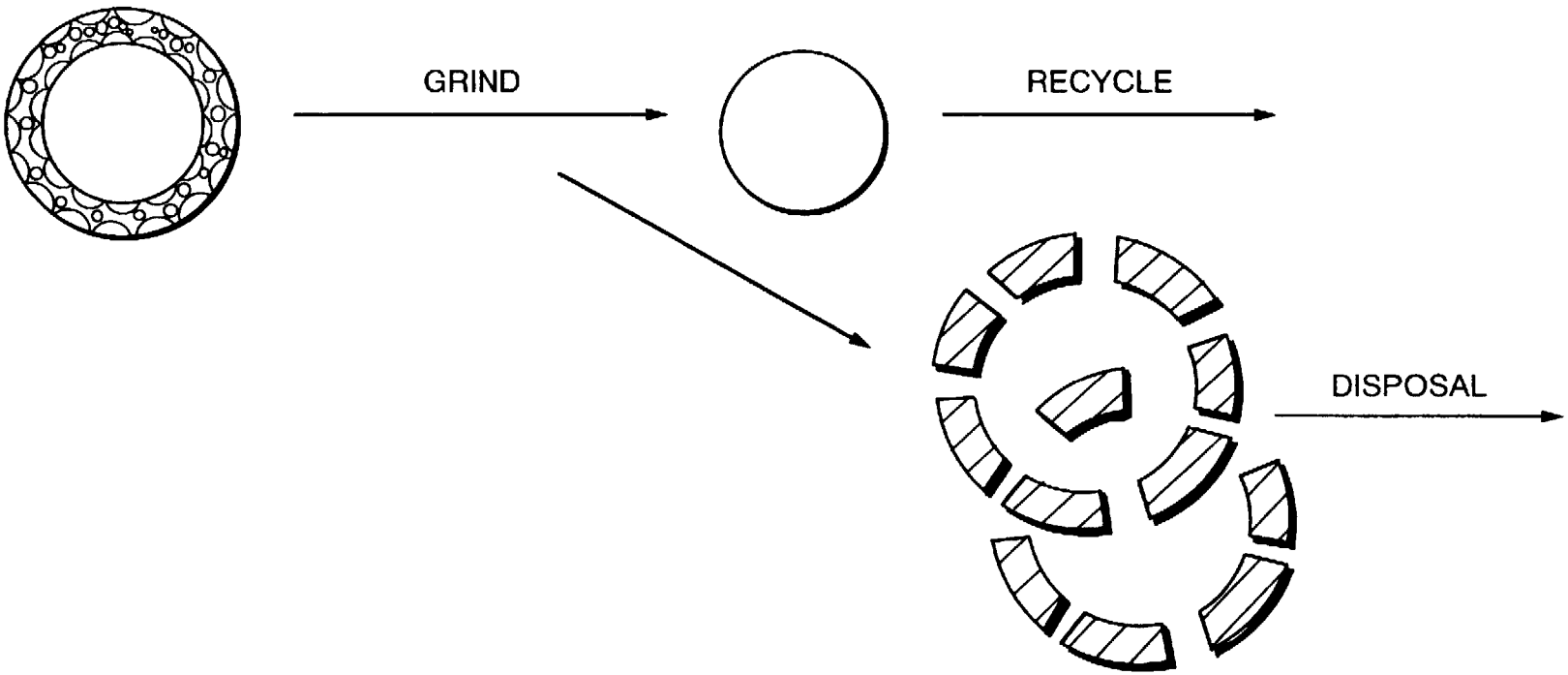
FIG. 16 is a schematic diagram of a metal-laden equilibrium cracking catalyst particle before grinding and after grinding which removes a substantial portion of the metal coating as fines for disposal. These fines may be separated in the classifier or magnetic separation device.

This example shows how attrition grinding 80 is used to reduce particle size. As will be shown, however, this grinding is preferably of a special kind. It does not reduce particle size by crushing particles but only by wearing off the outer shell of the catalyst particle to yield a lower metal, higher activity catalyst with reduced diameter (FIG. 16).

Studies of fluid flow behavior of FCC particles, see Zenn and Othmer, Fluidization and Fluid Particle Systems, Reinhold Chemical Engineering Services, 1966, have shown that there is a narrow range of particle size acceptable for best catalytic cracking processing (FIG. 10). Too coarse a material results in difficult particle flow and distribution and burping of the bed and poor oil contact. On the other hand, very fine particle size makes it operationally difficult to retain catalyst. Further, it has been established by experience over many years by many refiners, that a particle distribution most preferably in the 40–80 micron range, as mentioned above, gives best overall performance.

Figure 17:
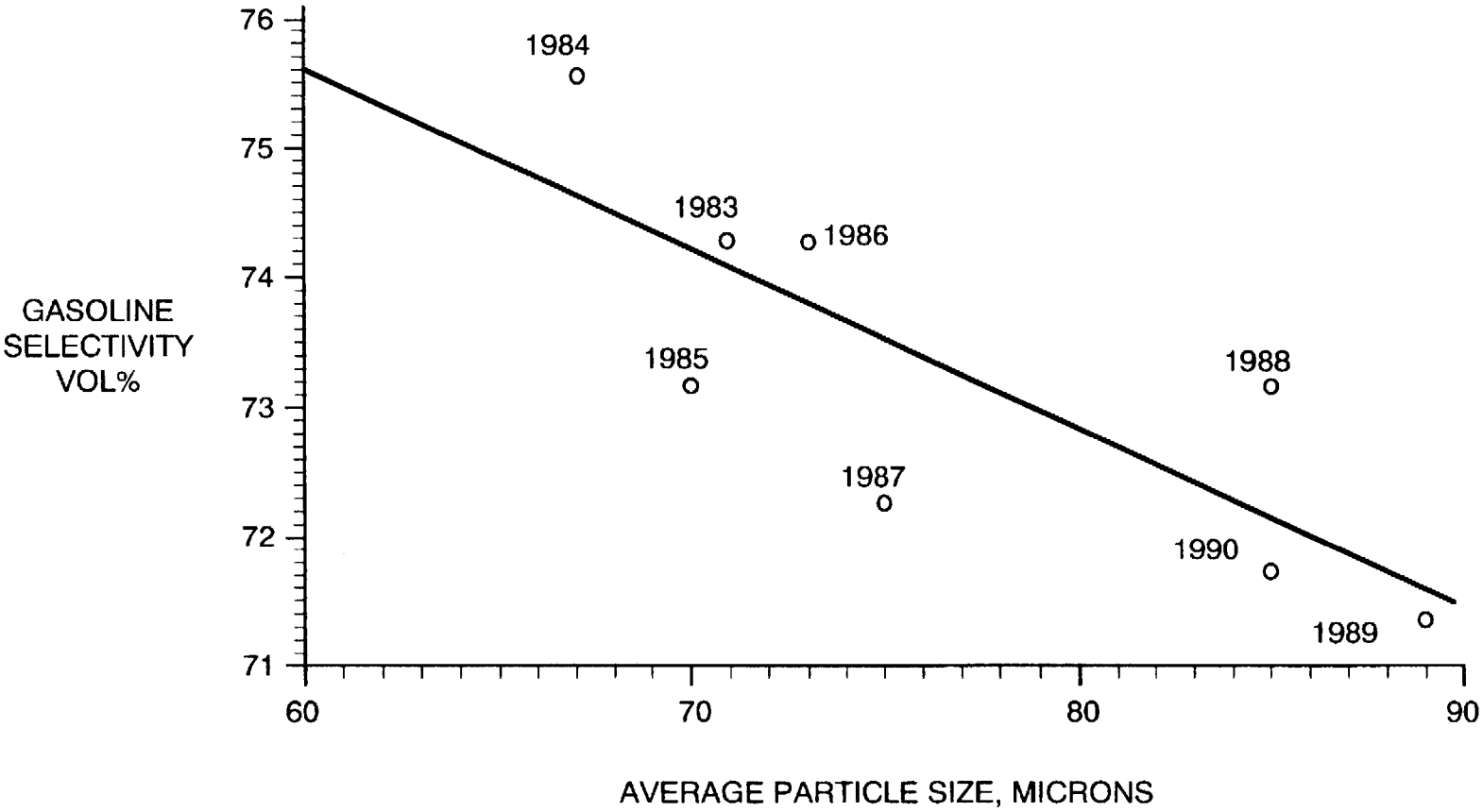
FIG. 17 is a computer aided evaluation of resid cracking process performance based on daily data over a period from 1984 through 1990, plotting the best straight line (by computer-aided evaluation) of gasoline selectivity (volume %) versus average particle size in microns for the catalyst used in a resid cracking unit, and demonstrating that gasoline selectivity drops from 74.8 at 76 microns to 71.4% at 90 microns average particle size, a loss of 3.4 volume % gasoline.

These studies show that at least for heavy residual processing in a catalytic cracking operation, average particle size (APS) can adversely affect selective conversion to gasoline. FIG. 17 shows a plot of APS for runs on a resid cracker over a period of eight years, wherein the average particle size (APS) varied from as low as 67 microns for one year and as high as 89 for another of these years. It can be seen that the selectivity (i.e. the amount of gasoline produced at a given conversion of feedstock) dropped from 74.8% at 67 microns to 71.4% at an APS of 90. This represents a very significant economic penalty for coarse catalyst, as the objective of catalytic cracking is to produce gasoline, and here there is a loss of 3.4 vol. % gasoline for the same conversion of oil, thus indicating the need to keep particle size at a lower average value.

However, FIG. 9 shows in contradiction, that best catalyst activity is found in the coarser catalyst fractions. This then indicates that although there is a need to continually reduce catalyst particle size to keep it in a desired range, there is also an opportunity of maintaining or even increasing activity or selectivity.

As previously described, metal accumulates on a particle, both directly with time and inversely to particle size. Separate studies of cross-sectional distribution of metal throughout catalyst microspheres have shown that iron and, to a certain extent nickel, accumulate in the outer shell, while vanadium distributes rather uniformly throughout. See FIG. 18, which shows an Energy Dispersive X-ray Analysis of a typical particle showing this typical metal distribution.

Figure 4:
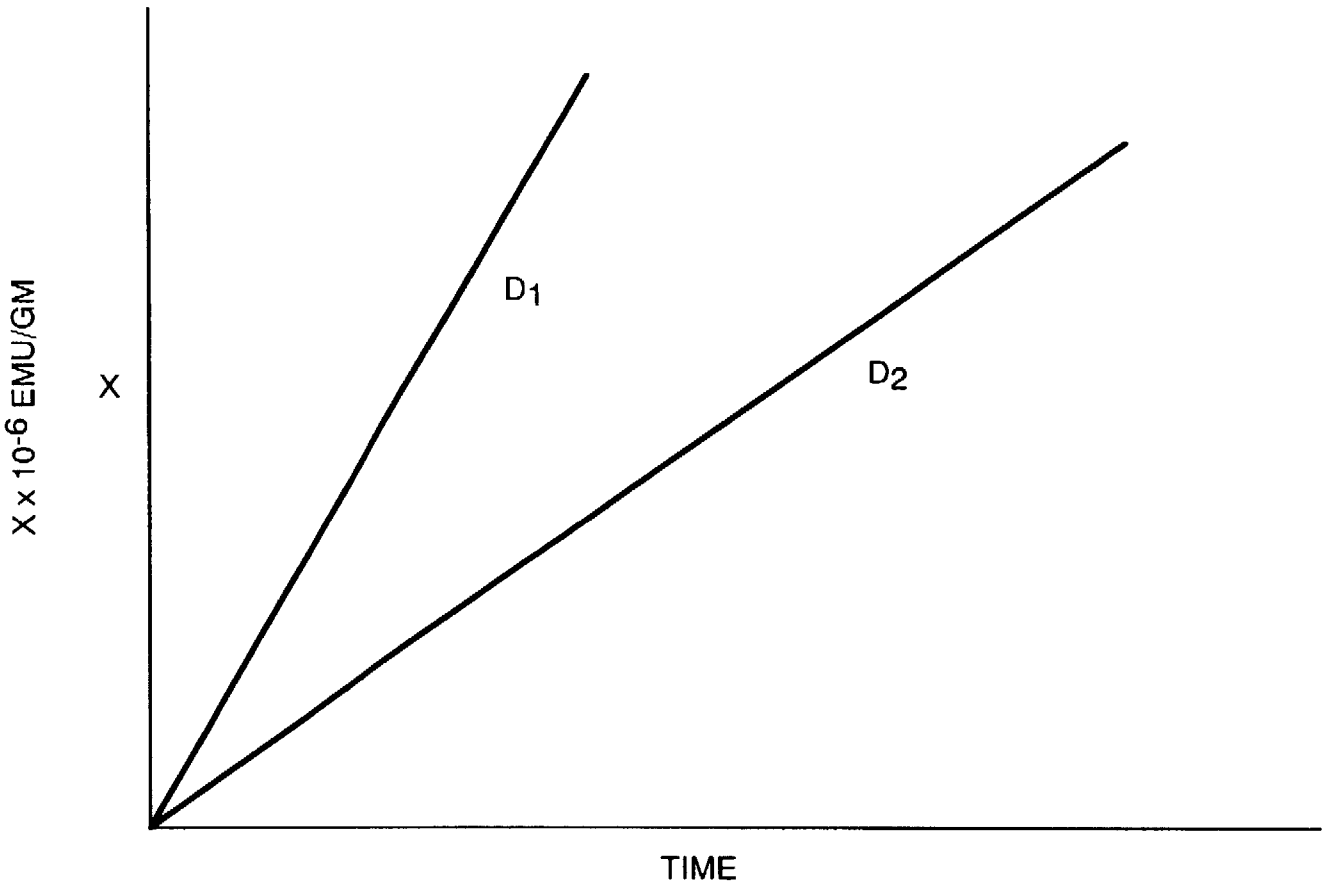
FIG. 4 shows increase in magnetic susceptibility versus time for a smaller and a larger particle, confirming FIG. 3.

Careful grinding and attrition of the outer shell, can remove this outer shell. This means coarse catalyst can be reduced in size while, at the same time, removing metal. As a consequence, catalyst activity and performance are also enhanced, and highly valuable catalyst reclaimed and recycled to the unit, this further reducing operating cost. As mentioned, it is an object of this invention to utilize a combination of three processes, namely, magnetic separation, classification, and attrition (see FIG. 4) to achieve maximum metal removal, maximum activity and selectivity and proper catalyst size distribution, while also recapturing coarse catalyst for reuse.

This preferred three-unit process can either be used as a part of a magnetic separation process to recover and return preferred catalyst to the unit, or can be added onto the larger magnetic separation unit s;o as to control coarse catalyst, or the attriter-classifier can less preferably and less effectively be employed without magnetic separation.

This Example 6 demonstrates the use of a commercially available attriting or grinding device, which when properly operated according to our conditions, achieves a reduction in particle size of coarse catalyst, a reduction in metal content, and all enhanced activity catalyst (see FIG. 16), for an idealized portrayal of this operation.

Figure 19:
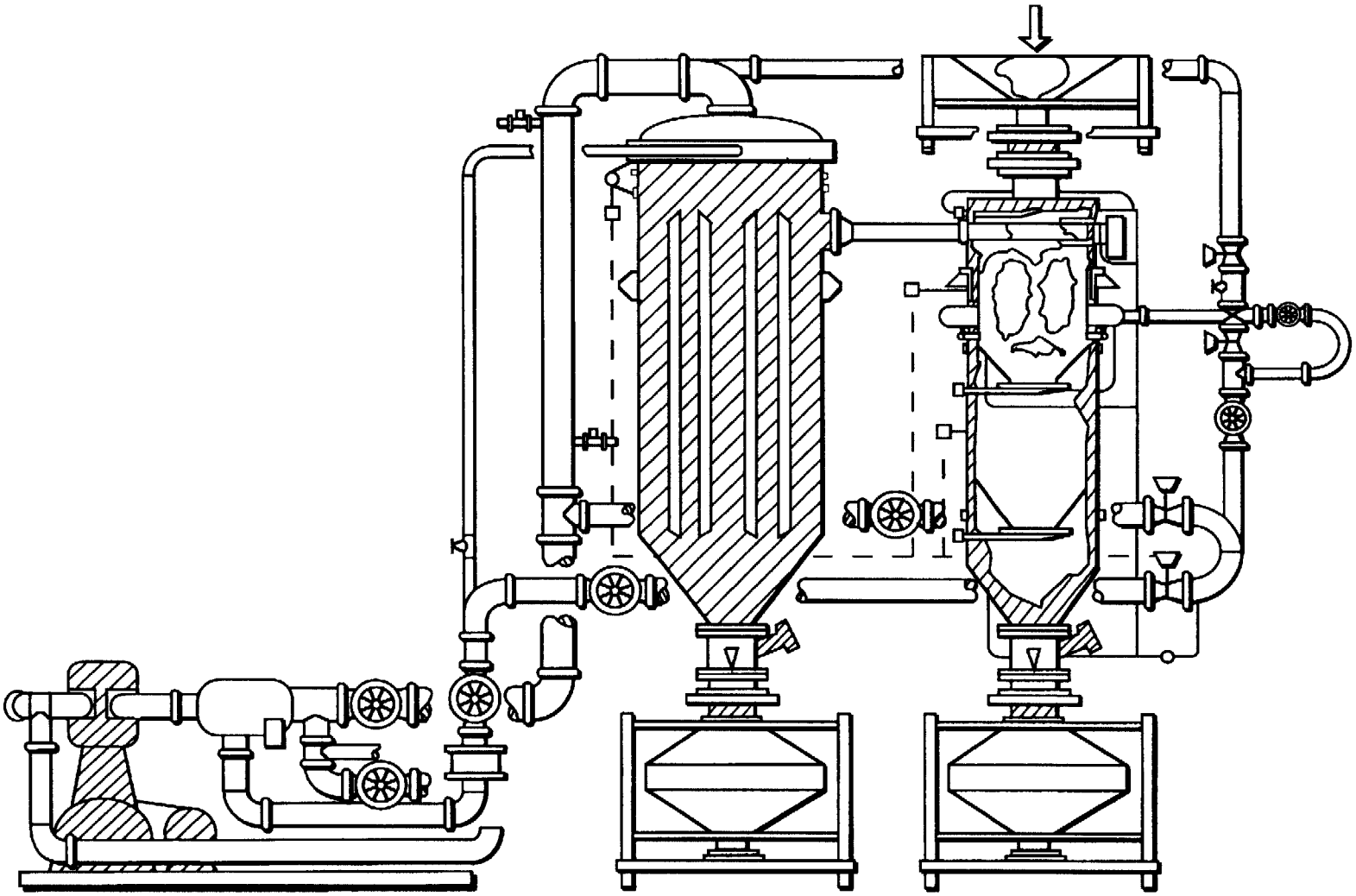
FIG. 19 is a relatively detailed schematic showing a complete grinding plant with compressed air supply and embodying the Model AFG-100 Fine Grind Jet Mill also manufactured by Alpine, which is a most preferred attrition means for use with the present invention because it tends to grind off the outer edge or surface of the particle as shown in FIG. 16 rather than shattering the individual particles. Since, as shown in FIG. 18, metal is, to a large degree, concentrated on the surface, removing the surface tends to reduce the metal content without shattering the catalyst particle into undesirable fines. Fluid energy mills are particularly preferred attriters.

In this Example 6, coarse product resulting from a similar classification run on the same high metal equilibrium catalyst described in the previous example yields 23% coarse catalyst with a particle size distribution 62% greater than 104 microns. This coarse cut had a magnetic susceptibility of $15.1\times10^{-6}$ emu/gm. Three grinding runs are made on a 100 Alpine Fine Grinder (AFG) Jet Mill unit (See FIG. 19). Table 7

TABLE 7

Particle Grinding

| | Example | | |
|---|---|---|---|
| | 6A | 6B | 6C |
| Run # | 11 | 12 | 13 |
| Grinding Chamber Pressure | −5MBAR | 0 | 0 |
| Product Fine # (Cyclone) | 0.3634 | 0.595 | 0.4295 |
| Grind Air Psig | 4 bar | 6 bar | 3 bar |
| Product Coarse # | 1.0 | 0.694 | 0.903 |
| Gap Rinse Air | 0.6 BAR | 0.6 BAR | 0.6 BAR |
| Baghouse Product # | 0.066 | 0.044 | 0.077 |
| Bearing Rinse Air | 0.5 BAR | 0.5 BAR | 0.5 BAR |
| Percent Fine | 26.3 | 46.5 | 32.3 |
| Percent Coarse | 73.0 | 53.5 | 67.7 |
| Nozzle Size | 1.9 MM | 1.9 MM | 1.9 MM |
| Time, min. | 10 | 10 | 10 |
| RPM | 10,000 | 10,000 | 10,000 |
| Feed Rate #/hr. | 8.22 | 7.74 | 7.98 |
| Amps Empty | 1.2 | 1.2 | 1.2 |
| Relative Humidity % | 13 | 13 | 13 |
| Amps Full | 1.5 | 1.5 | 1.4 |
| Temp. °F. | 74 | 74 | 74 |
| Grinding Air Temp | Ambient | Ambient | Ambient |
| Baghouse Pressure | 0 | 0 | 0 |
| Feed (lbs.) | 1.37 | 1.29 | 1.33 |
| % Recovery of Ground Product | 73.0 | 53.5 | 67.7 |

Table 8 shows the yield and magnetic properties of the product. As can be seen, in each run there was, reduction in coarse product, but magnetic susceptibility also was significantly reduced, confirming that magnetic generating metals, such as nickel and iron, had been reduced in concentration.

TABLE 8

Product Composition

| | Feed 11 | | 11 | 12 | | 13 | |
|---|---|---|---|---|---|---|---|
| Yield | Xg | Wt. % | Xg | Wt. % | Xg | Wt. % | Xg |
| Coarse Chamber | 16.8 | 73.0 | 11.4 | 53.5 | 10.0 | 67.3 | 11.6 |
| Cyclone | | 26.5 | 51.1 | 46.1 | 25.2 | 32.2 | 25.5 |
| Baghouse | | 0.5 | 32.0 | 0.4 | 21.9 | 0.5 | 23.6 |

Extensive dry sieving of chamber product from Run 13, Xg dropped to 9.2. Further washing of dry sieve product from Run 13, Xg dropped to 8.1.

In Table 9 is shown the results of particle size analysis of the chamber or coarse product of runs #11, #12, and #13. As can be seen, there is an appreciable drop in particle size (APS) along with the drop in magnetic susceptibility confirming that this careful grinding technique has not shattered the particles, but simply reduced them in size. Microscopic examination of the chamber product showed over 95% remaining as microspheres.

TABLE 9

| | Run # | | | |
|---|---|---|---|---|
| Wt. % | Feed | 11 | 12 | 13 |
| +100 Mesh | 15 | 10 | 11 | 8 |
| +150 | 47 | 33 | 35 | 26 |
| +200 | 20 | 32 | 29 | 28 |
| +325 | 17 | 12 | 13 | 15 |

TABLE 9-continued

| Wt. % | Run # Feed | 11 | 12 | 13 |
|---|---|---|---|---|
| −325 | 1 | 13 | 13 | 23 |
| % >150 mesh | 62 | 43 | 46 | 34 |
| APS microns | 116 | 99 | 96 | 91 |
| Chamber Yield | | 73.0 | 53.5 | 67.7 |
| Wt. % Yield of +325 | | 63.5 | 46.5 | 52.0 |
| Wt. % Yield-Equil. Cat. | 23.0 | 14.6 | 10.6 | 12.0 |
| % of Original Coarse Feed | 100.0 | 63.4 | 46.1 | 52.2 |

Table 10 shows how effective grinding is. Chemical analysis for iron, nickel and vanadium is shown for the feed and for each of the fractions resulting from grinding. As can be seen there is a drop in iron, nickel and vanadium from the feed to the chamber product, with the attrition product fines showing up with much higher metals level, proving that the metal removal from the outer shell was very effective.

TABLE 10

| Run # | | Feed | 11 | 12 | 13 | #13 Chamber Water Washed |
|---|---|---|---|---|---|---|
| Feed | ppm Fe | 7,339 | | | | |
| | ppm Ni | 1,794 | | | | |
| | ppm V | 3,875 | | | | |
| | | 13,008 | | | | |
| Chamber | ppm Fe | | 6,640 | 6,430 | 6,850 | 6,570 |
| | ppm Ni | | 1,594 | 1,559 | 1,643 | 1,595 |
| | ppm V | | 3,639 | 3,532 | 3,689 | 3,409 |
| | | | 11,873 | 11,521 | 12,162 | 11,564 |
| Cyclone | ppm Fe | | 9,017 | 8,038 | 7,967 | |
| | ppm Ni | | 2,115 | 1,978 | 1,965 | |
| | ppm V | | 4,040 | 3,941 | 3,831 | |
| | | | 15,172 | 13,957 | 13,763 | |

Table 11 shows the percent reduction of nickel, iron, and vanadium for the recovered +325 mesh product for these three runs. Microscopic examination of the chamber product showed some very fine ground dust clinging to the surface, apparently electrostatically, making final interpretation a little cloudy. Reexamination of these particles after water washing on a +325 sieve showed them to be mainly very spherical particles (over 95%) and appearing to be somewhat cloudy in appearance as against the glossy appearance of the feed, again suggesting that a scouring of the surface had been achieved.

TABLE 11

| Run # | 11 | 12 | 13 | #13 Chamber Water Washed |
|---|---|---|---|---|
| % Fe Reduction | 10 | 12 | 7 | 11 |
| % Ni Reduction | 11 | 13 | 8 | 11 |
| % V Reduction | 6 | 9 | 5 | 12 |

Because of the small particle size of the cyclone and baghouse fines, catalyst activity testing of fines would be meaningless, but run T-7 coarse feed and chamber product from runs #11, #12, and #13 are also submitted for activity testing. Table 12 shows the results of these tests.

TABLE 12

| Run # | Feed | 11 | 12 | 13 |
|---|---|---|---|---|
| Vol. % Conversion | 67.9 | 69.7 | 69.2 | 69.8 |
| Relative Activity | 49 | 59 | 56 | 60 |
| Vol. % Gasoline | 59.2 | 59.7 | 59.9 | 60.2 |
| Wt. % Coke | 4.52 | 4.49 | 4.40 | 4.58 |
| Wt. % $H_2$ | 0.32 | 0.32 | 0.33 | 0.33 |
| Coke Selectivity | 2.14 | 1.97 | 1.97 | 2.00 |

The significant increase in catalyst activity and reduction in coke selectivity confirm the uniqueness of this method and the potential savings. The original coarse catalyst with a relative activity of 49 was cleansed of metal, reduced in size and increased some 22% in activity, while also improving coke selectivity, and recovering of 53.5 to 73 wt. % of very desirable catalyst and corresponding reduction in disposal costs.

This example shows the value of including grinding/attrition in the total three process rejuvenation/reconditioning/refreshing scheme.

These results, together with particle size separations and magnetic separation, show that an appreciable amount of catalyst can be rejuvenated and/or cleaned mechanically, with highly attractive economic incentives and without requiring chemicals or conventional replacement with expensive new catalyst.

Washing and more thorough screening of chamber catalyst to remove small amounts of very fine (<5 microns) high metal fines apparently electrostatically attached to the surface of large spheres, shows magnetic susceptibility drops to 9.2 from 11.5, and after water washing to further remove catalyst fines, magnetic susceptibility dropped to 8.1, adding further proof that attrition grinding is an attractive and vital part of the process.

EXAMPLE 7

(oversized non-mag)

When a sample 80 of fluid catalytic cracking catalyst, contaminated with a number of portions of large particles of lagging and lumped catalyst having a size above 150 microns is processed by the same techniques as employed in Example 1 of U.S. Pat. No. 5,147,527, but with the modified apparatus shown in FIG. 1*c* of the present application, having an additional catch-tray 81 positioned to the right of "non-mags" tray in FIG. 1*c*, the centrifugal force of the belt 82 acting on these larger, substantially non-magnetic particles 84, throws them into a trajectory extending to the right of the apparatus shown in FIG. 1*c*, and they fall into this fourth catch-tray which can be labeled "oversize non-mags". The elimination of these oversized non-magnetic particles substantially improves the fluidization and reduces "bumping" and other upsets in the operation of the FCC when the remaining "non-mags" are returned to the FCC unit. Thus, the moving-element magnetic separator of FIG. 1*c* can be adapted to provide not only magnetic separation, but also ballistic separation of oversized particles which would otherwise deter fluidization of the circulating FCC catalyst.

place of the belt 82, another moving element passing through a magnetic field, such as a rotating disc or roller can be substituted.

EXAMPLE 8

(high mag off first)

FIG. 8 illustrates the advantage of taking the highly magnetic portion of the catalyst or other particles off first.

This has the advantage of handling much less material in order to process a given amount of particulate feed. Therefore, it is generally cheaper than taking the low magnetic susceptibility portion off first for any intermediate technique. Further, the separation is generally substantially more sharp when the high magnetic fraction is taken off first.

EXAMPLE 9

(classification alone)

Figure 1A:
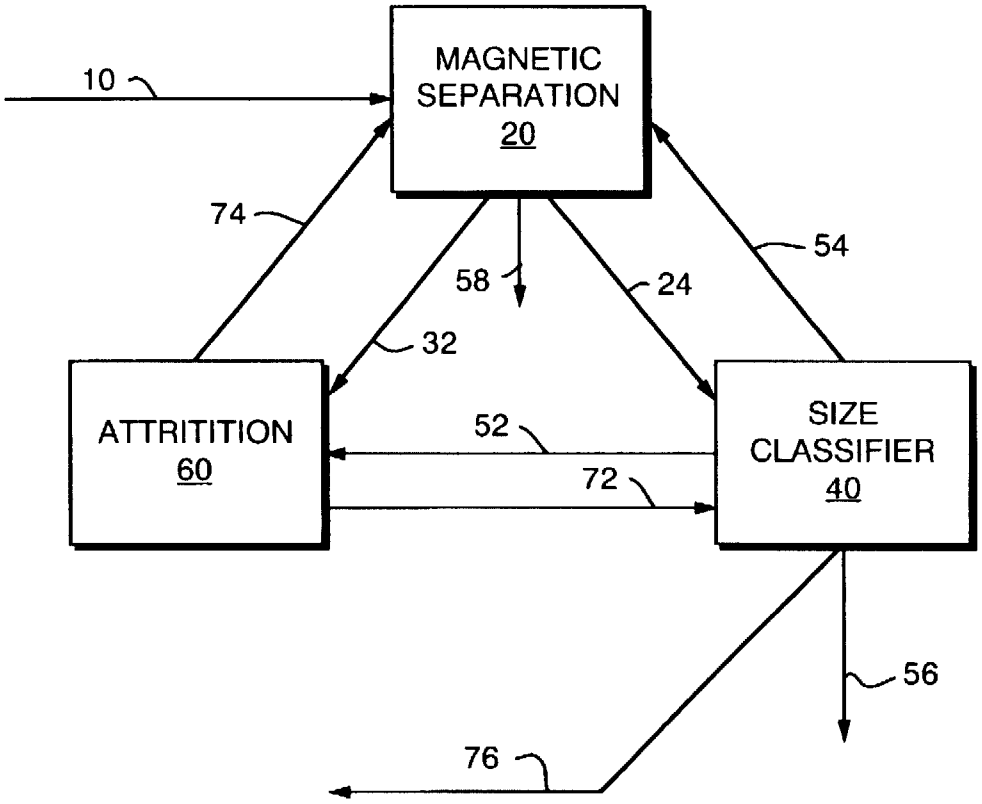
FIG. 1*a* shows schematically the preferred apparatus of the invention comprising magnetic separation means 20, size classification means 40, and attrition means 60 with feed 10 of catalyst or sorbent, from a hydrocarbon conversion unit, and dump 56 of fines to waste and recovery and 58 high metal to waste, and recycle 76 back to the hydrocarbon conversion unit with intermediate recycles 32, 74, 54, 24 and 52, 72 between the components of the invention. These recycles may be optimized for maximum conversion of optimum catalyst.
Figure 1C:
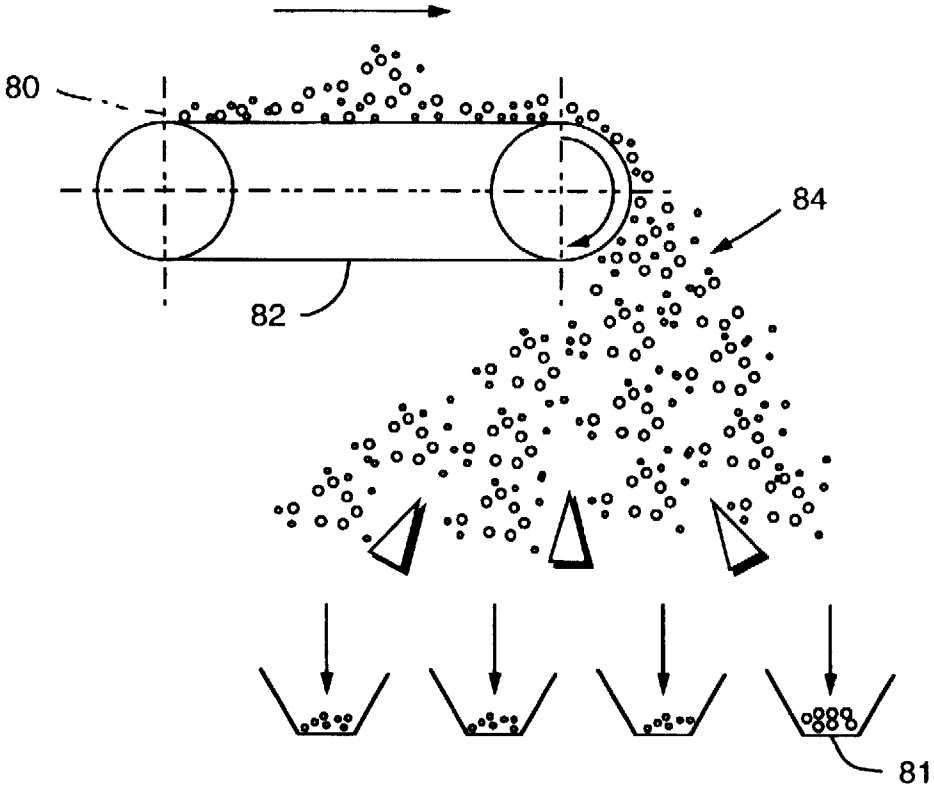
FIG. 1*c* shows schematically a particularly preferred separation apparatus 20 of the type shown in FIG. 1*a*.
Figure 2:
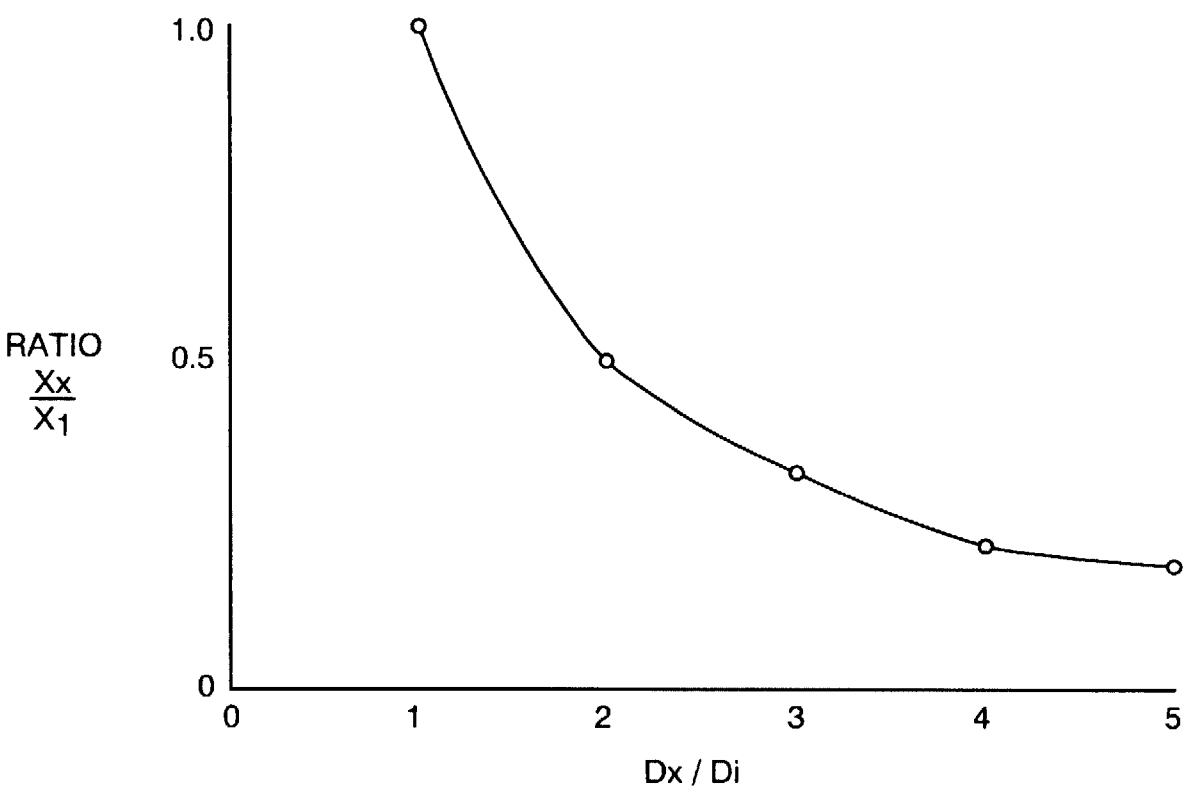
FIG. 2 is a plot of the ratio of magnetic susceptibility, x, and particle size (diameter), 0 and shows that magnetic susceptibility decreases by 50% as particle size doubles.
Figure 3:
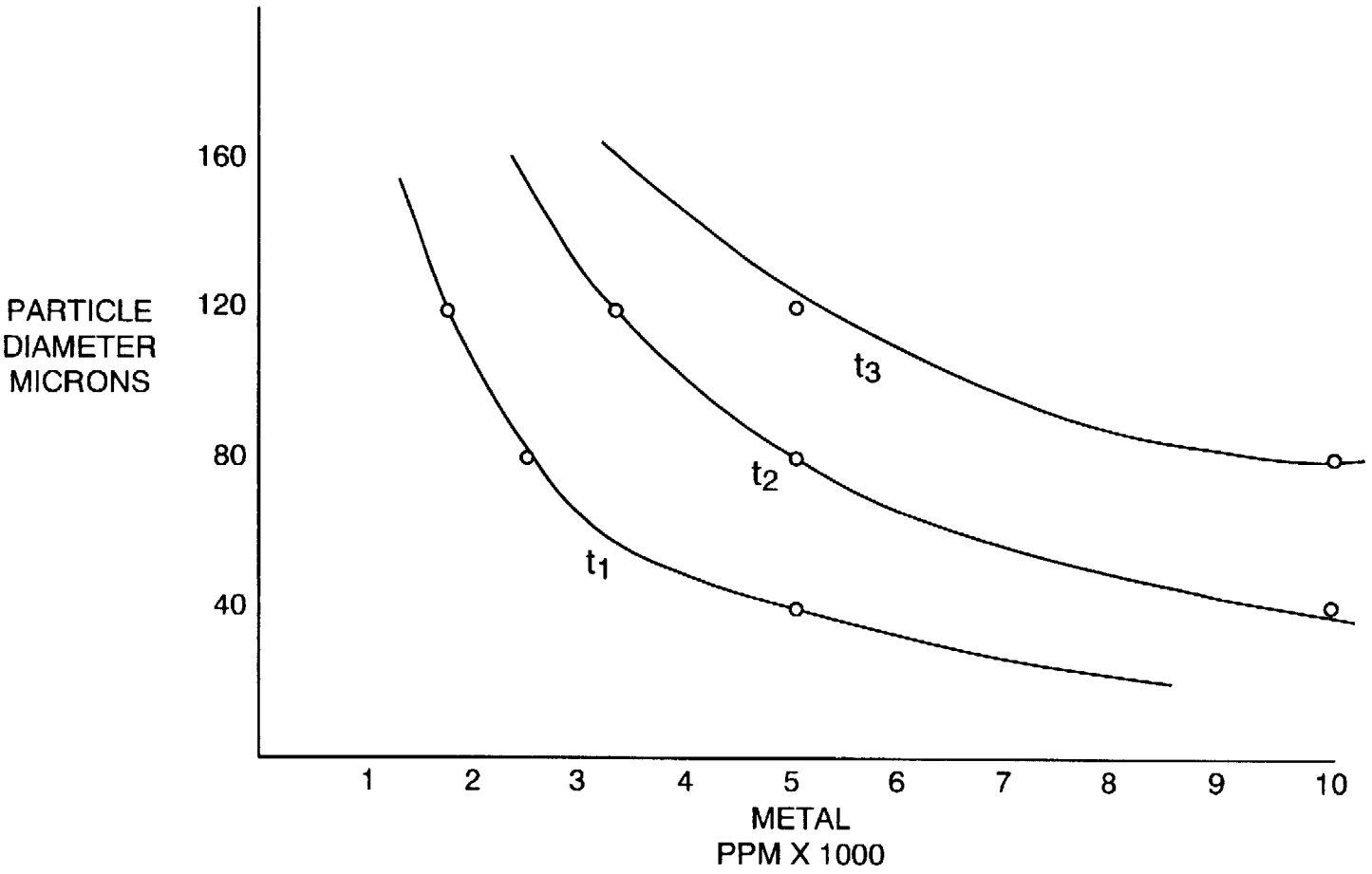
FIG. 3 shows metal-on-catalyst at three different intervals of time t versus particle diameter in microns.

When the apparatus of FIG. 1a is used to separate the same feed as in Example 1, but the magnetic separator 20 and the attrition zone 60 are by-passed so that all separation is performed by size classifier 40, it is found that the size classifier 40 splits the feed into a higher and a lower magnetic susceptibility. This confirms that classification, even if not at the theoretical or "ideal" level for sieving, does separate out an enriched fraction of 104-micron-plus particles and a lesser content of these particles in a second fraction. Because of this separation, classification also shows some enrichment of metals in one fraction, and some reduction of metal levels in the other so that a first fraction is provided with metals level higher than the average metals level of said feed, and a second fraction is provided with metals level lower than the average metal level of said feed. This is shown in FIG. 8 which plots separately a sieve separation of the same feed; a high mag off first separation of the same feed; and a lower magnetic off first separation of the same feed. Note that this technique, as a pretreatment before magnetic separation, avoids dilution of the magnetic material, thus provides more efficient separation.

EXAMPLE 10

(Feed sources: ebulating, moving, and fixed bed catalyst)

This Example demonstrates that non-fluid-catalytic-cracking catalysts can also profit substantially from the invention. In fact, the invention has even more advantages with fixed or ebulating bed catalyst because the replacement of catalyst is often more difficult and/or expensive with non-circulating catalysts such as these. The invention acts to separate the metal contaminated catalyst from the less metal contaminated catalyst and reduces the quantity of catalyst which must be replaced into the ebulating or fixed bed, while extending the overall life of the catalyst bed.

In fixed bed catalyst, it is customary to continue to operate until a "turnaround", at which time the entire bed is dumped and replaced and often sent for expensive reprocessing. This conventional practice necessarily involves a reduction in the activity of the catalyst as the turnaround approaches, often reducing severely the activity of the catalyst bed as it accumulates month's of service.

In the present Example, an ebulating hydrotreating and/or hydrocracking catalyst bed, such as American Cyanamides "Cytec" catalyst, is used with the invention. However, the invention is similarly applicable to fixed beds with provision made for removing the bed and magnetically separating all or a portion of the fixed bed catalyst periodically. Such beds are used in hydrocarbon conversion for hydrotreating, solid catalyst alkylation, hydrocracking, and reforming.

Figure 20:
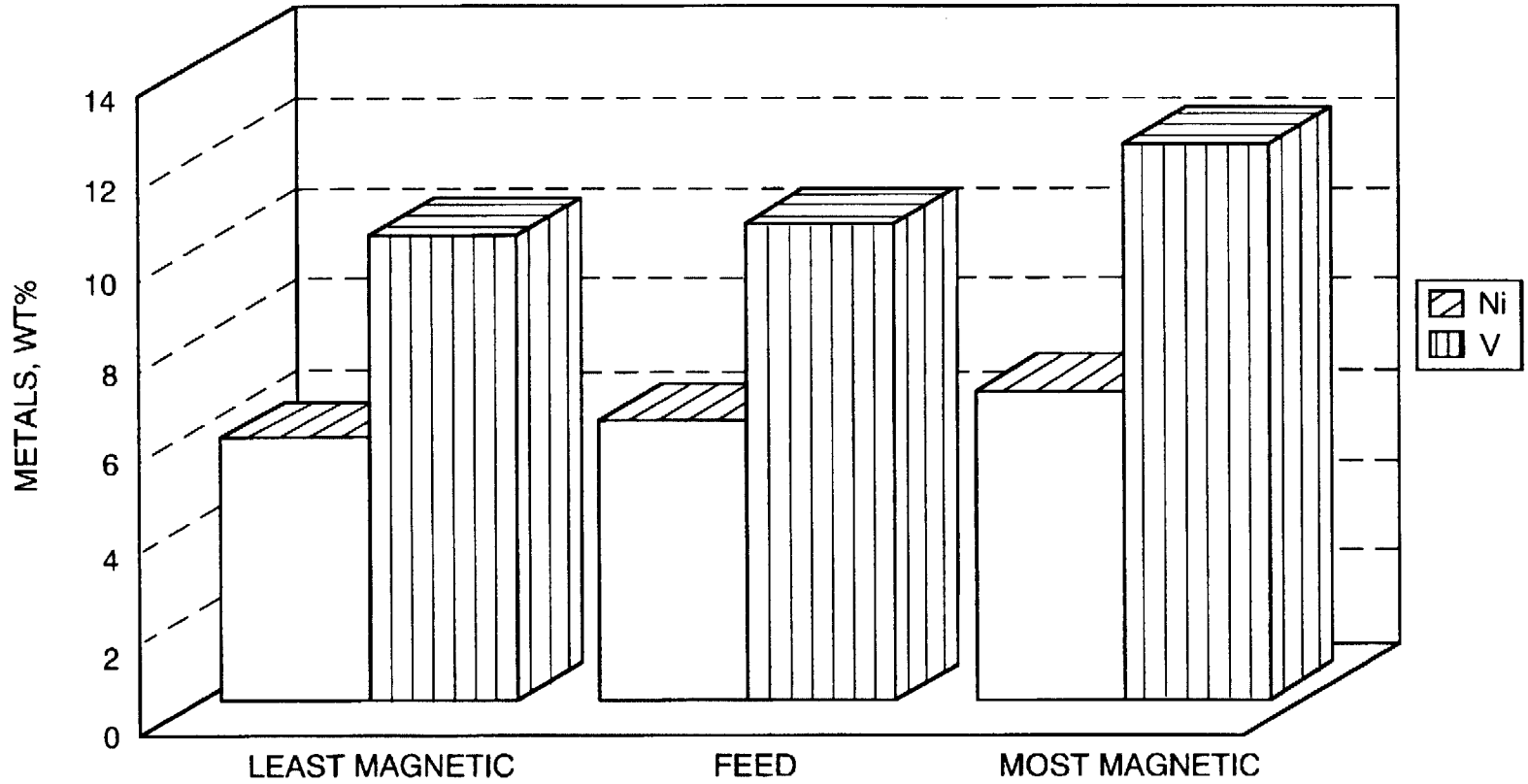
Figure 21:
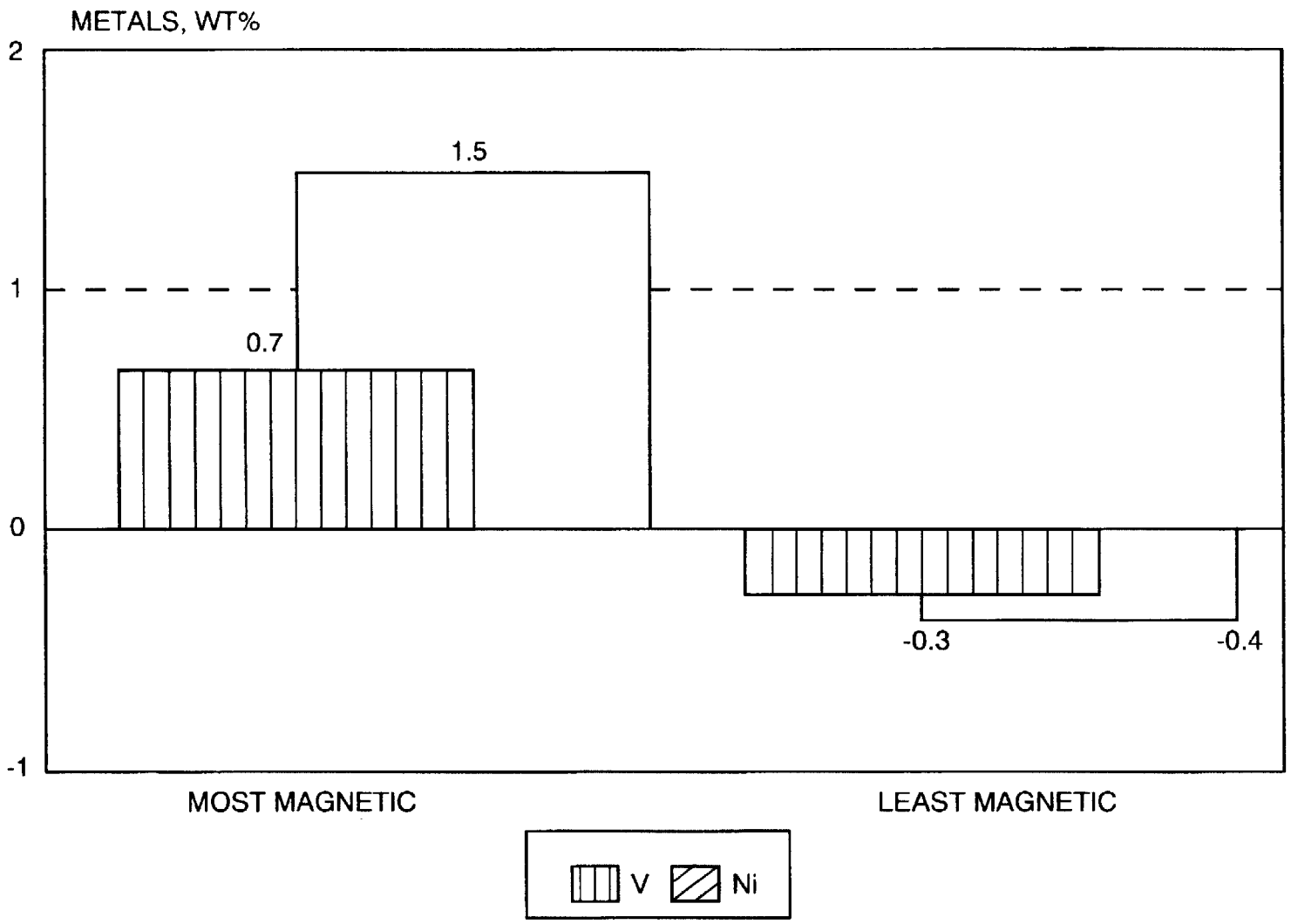

When equilibrium catalyst is withdrawn daily and subjected to magnetic separation similar to that described in Example 1, except that attriter 60 and classifier 40 are by-passed so that separation is solely by magnetic separator 20, approximately 1 to 50 (more preferably 10 to 30) weight percent of the withdrawn catalyst, having an average contaminant metal on catalyst of about 0.2 to 1.4 weight percent, is discarded. The remaining catalyst is returned to the reactor where reactor efficiency is maintained substantially higher than if the bed had not been treated by magnetic separation during its operation. Yields are accordingly higher, selectivity is higher and throughput can be maintained approximately level for a time longer than the normal time between turnarounds of this reactor. (The advantage of ebulating bed is that, like FCC reactions, catalyst is continually added and withdrawn, lending to constant activity.) Results of a run are shown in FIGS. 20 and 21.

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein. For example, the invention can be applied to sorbents such as those used in U.S. Pat. Nos. 4,309,274, 4,263,128, and 4,256,567, as well as to cracking catalysts, and both are included within the claims. The attriter 60 and the classifier 40 can be used as a pair for some catalyst recovery, and the magnetic separator 20 plus attriter or plus classifier can also be used as a pair, though the three component "triangle" of FIG. 1 is most preferred.

More than one separator or attriter or classifier may be employed in cascade or other arrangement.

Reference to documents made in the specification is intended to result in such patents or literature being expressly incorporated herein by reference including any patents or other literature references cited within such documents.

What is claimed is:

1. A process for separation of higher metal fractions from lower metal fractions of particulates comprising fluidized catalytic cracking catalyst containing metals from a fluidized catalytic cracking process, comprising classifying classification by elutriation or fluidized centrifugation of said catalyst to split said catalyst into a higher metals-containing fraction and a lower metals-containing fraction and wherein said lower metals-containing fraction is comprised of particulates of larger average diameter than the particulates of the higher metals-containing fraction.

2. A process according to claim 1 wherein said metals comprise magnetic metals.

3. A process according to claim 1 wherein said classification is accomplished by fluidized cyclone means, screening or vibrating means.

* * * * *